United States Patent [19]

Hulterstrum et al.

[11] Patent Number: 4,930,914

[45] Date of Patent: Jun. 5, 1990

[54] APPARATUS FOR MAKING TACTILE IMPRESSIONS ON PAPER

[75] Inventors: Harold D. Hulterstrum; Thomas R. Luck, both of Baraboo, Wis.

[73] Assignee: K Enterprises, Inc., Plover, Wis.

[21] Appl. No.: 180,149

[22] Filed: Apr. 11, 1988

[51] Int. Cl.[5] ..... B41J 3/32

[52] U.S. Cl. ..... 400/122; 400/124

[58] Field of Search ..... 400/84, 122, 124, 82, 400/154.1; 101/10

[56] References Cited

U.S. PATENT DOCUMENTS

| | | | |
|---|---|---|---|
| 780,102 | 1/1905 | Hammond . | |
| 1,953,307 | 4/1934 | Naumburg . | |
| 2,300,297 | 10/1942 | Lampson . | |
| 3,565,230 | 2/1971 | Webberley et al. | 400/154.1 |
| 3,876,052 | 4/1975 | Carbonneau . | |
| 3,880,269 | 4/1975 | Carbonneau . | |
| 4,108,066 | 8/1978 | Anderson | 101/22 |
| 4,183,683 | 1/1980 | Hiratsuka et al. | 400/122 |
| 4,261,663 | 4/1981 | Grimnes | 101/18 X |
| 4,397,573 | 8/1983 | Thiel | 400/122 |
| 4,423,972 | 1/1984 | Inoue et al. | 400/157.2 X |
| 4,488,828 | 12/1984 | Ohtsuki | 400/82 |
| 4,500,293 | 2/1985 | Eltgen | 434/114 |
| 4,551,102 | 11/1985 | Meinzer | 400/122 X |

FOREIGN PATENT DOCUMENTS

| | | | |
|---|---|---|---|
| 2350961 | 9/1977 | France | 400/122 |
| 236771 | 11/1985 | Japan | 400/122 |
| 58765 | 3/1986 | Japan | 400/122 |
| 249779 | 11/1986 | Japan | 400/122 |
| 2098929 | 12/1982 | United Kingdom | 400/122 |

OTHER PUBLICATIONS

IBM Tech. Disc. Bulletin, "Serial Printing a Embossing Device", vol. 21, No. 11, Apr. 1979, Loeber; pp. 4639–4640.

*Primary Examiner*—Edgar S. Burr
*Assistant Examiner*—Joseph R. Keating
*Attorney, Agent, or Firm*—Allegretti & Witcoff, Ltd.

[57] ABSTRACT

Apparatus for making tactile impressions, such as a Braille matrix, on paper. The apparatus includes a paper receiver, pins, a driver, and a rotating print wheel. The receiver accepts paper, and the driver selectively extends pins toward the paper. The print wheel rolls over the pins, pressing the paper and pins in close contact. Consequently, the pins leave a tactile impression on the paper.

19 Claims, 8 Drawing Sheets

148
172
174
176
DATA
152
EPROM
RAM
RAM
RAM
RAM
RAM
RAM
RAM
RAM
182
154
156
180
WR
WR/A11
A12
RO
CE
CE
CE
CE
CE
CE
CE
CE
180
178
3TO8
DECODER

APPARATUS FOR MAKING TACTILE IMPRESSIONS ON PAPER

BACKGROUND OF THE INVENTION

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

The present invention relates generally to printers and more particularly to an apparatus for making tactile impressions, such as a Braille matrix, on paper. The tactile impressions may be felt through the skin by visually impaired persons. A variety of systems for representing letters, words, or thoughts with tactile impressions on paper now exist. For example, a commonly used system, developed by Louis Braille in the early 1800's, uses predetermined combinations of raised circular dots, or "dimples," to represent letters of the alphabet.

In the Braille system, for example, each English language letter is represented by a combination of 1–6 raised dots. Dots for a particular letter are grouped together in two vertical columns, each column having up to three dots.

Communications using tactile impressions on paper are an important vehicle for allowing visually handicapped persons to communicate with others. Unfortunately, many of the printers available to make such tactile impressions are complex and expensive machines, which many visually handicapped persons cannot afford to own. Furthermore, the available machines are o often simply too large, noisy and unreliable to be a workable tool for the visually impaired.

Moreover, many of such tactile printers can only use particular types of paper, further increasing the cost of providing Braille material to the blind. Also, many printers are large, heavy to transport, and difficult and expensive to maintain.

Many tactile printers use impact technology to create raised dots, and thus are very noisy and mechanically unreliable. Such printers are often too noisy to function effectively in an office environment that a blind person may wish to work in.

In addition, many of the tactile printers commonly available give poor quality impressions on paper. Others cannot use standard paper that is commonly available and used by sighted persons. Still other printers may only use particular sizes of paper, which, in some applications, may be inappropriate or difficult to use. This is particularly true if, for example, a visually impaired person wishes to do a large spread sheet or to print or "read" graphics. Still further, some printers take too long to operate, such that when connected to a word processor, a blind typist may spend a considerable period of time before being able to "read" what he or she has typed by touching the tactile impressions. Other printers are difficult for the visually impaired to load with paper.

Overall, tactile printers should be more widely available to visually handicapped persons. The large size, complexity, high-cost and poor performance of many commonly available tactile printers reduce the amount of "written" material that is available for the visually handicapped. This, in turn, may preclude the blind from obtaining jobs that they otherwise are capable and willing to perform. The lack of "readable" material and reduced opportunities for jobs further isolates the blind from the rest of society and prevents them from assimilating into the environment and work places of sighted persons.

SUMMARY OF THE INVENTION

In a principal aspect, the present invention is an improved apparatus for making tactile impressions on paper. The apparatus includes a plurality of pins, a driver, and a print wheel. The driver selectively extends a pin toward the paper. The print wheel then presses the paper and pin in close contact. As a result, the pin is forced against the paper by the print wheel and leaves a tactile impression on the paper.

According to another feature of the present invention, the apparatus includes a plurality of drivers and a controller. The controller receives an input signal and responsively provides activation signals to the driver so that selected pins are raised to create tactile impressions when the print wheel passes over the paper and the extended pins. The controller may receive inputs from a variety of sources, including, for example, a word processor, optical scanner, computer, or modem.

Accordingly, an object of the present invention is an improved apparatus for making tactile impressions on paper. Another object is a tactile printer that has that has fewer parts. Thus, still another object is a tactile printer that is less expensive to manufacture and that will be less expensive for the visually handicapped to purchase. A further, related object is a tactile printer that is more durable and reliable. Yet another object is a tactile printer that prints faster, is smaller and lighter, and has fewer maintenance requirements.

A further object is a tactile printer that is more useful in an office environment. Thus, it is also an object to provide a tactile printer that is quieter and creates a higher quality of tactile impressions. Yet a further objective is a tactile printer that more readily accepts and uses a variety of different papers. Still another object is a printer that will be easier to load with paper. A further object is a tactile printer that is more easily connected to a word processor and, when so connected, will allow a blind typist to quickly "read" what has been typed.

Yet a further object is a printer that may accept and use a large variety of different sized of papers. Such a printer, for example, may more easily allow graphics or spread sheets to be set forth in a tactile form. A further object is a tactile printer that more readily utilizes inexpensive "used" paper, which may be obtained for use by the blind at a substantially lower cost than the more conventional "thick" paper traditionally used for Braille printing.

Another object is a printer that will more easily operate off standard data ports. The enhanced ability to operate using standard data ports may allow the blind to more easily communicate in society. Thus, for example, an inexpensive (and therefore more "available") tactile printer may be attached to a personal computer. The personal computer may, in turn, be connected to a modem. Two blind persons with such equipment may thus send and receive tactile documents over a telephone line.

The availability of a cheap, reliable, tactile printer thus has tremendous implications for allowing the blind to more easily assimilate into a sighted society. A blind person may carry a lightweight, reliable, quiet printer with him or her, for example, to the work place. With a standard word processor connected to a compact tactile printer, for example, a blind typist may type a letter to be read by sighted persons while, substantially at the same time, create for himself or other blind persons, a Braille version of the typed document. The blind typist is thus enabled to readily proofread the typed line or typed page before it is distributed. Also, by simply putting a normally typed document into an optical scanner, and then connecting the scanner to the tactile printer, the visually handicapped may "read" a conventional, ink-typed memorandum or letter almost as easily as a sighted person.

Furthermore, such a printer may more readily allow blind persons to read a newspaper. The contents of a newspaper may, for example, be readily stored on a computer disc. It may be put on the disc either by a newspaper concern itself or, alternatively, could be read by an optical scanner and then put onto a disc. Such a disc could then be put into a file in a personal computer "billboard" system. In this way, a blind person, with a personal computer, modem, and printer, may simply dial up the file over the telephone line and obtain a "dump" of the current newspaper file. The visually handicapped person may then transfer the newspaper file to the printer. Thus, in a matter of minutes, a visually handicapped person can "read" about current events in an up-to-date newspaper, rather than only listening to news programs on radio or television or waiting for the delivery of possibly outdated newspaper made with conventional Braille printing techniques.

These and other objects of the present invention will be more fully understood by reference to the following detailed description of the preferred embodiment.

BRIEF DESCRIPTION OF THE DRAWING

A preferred embodiment of the present invention is described herein with reference to the drawing wherein.

DETAILED DESCRIPTION OF A PREFERRED EMBODIMENT

Figure 1:
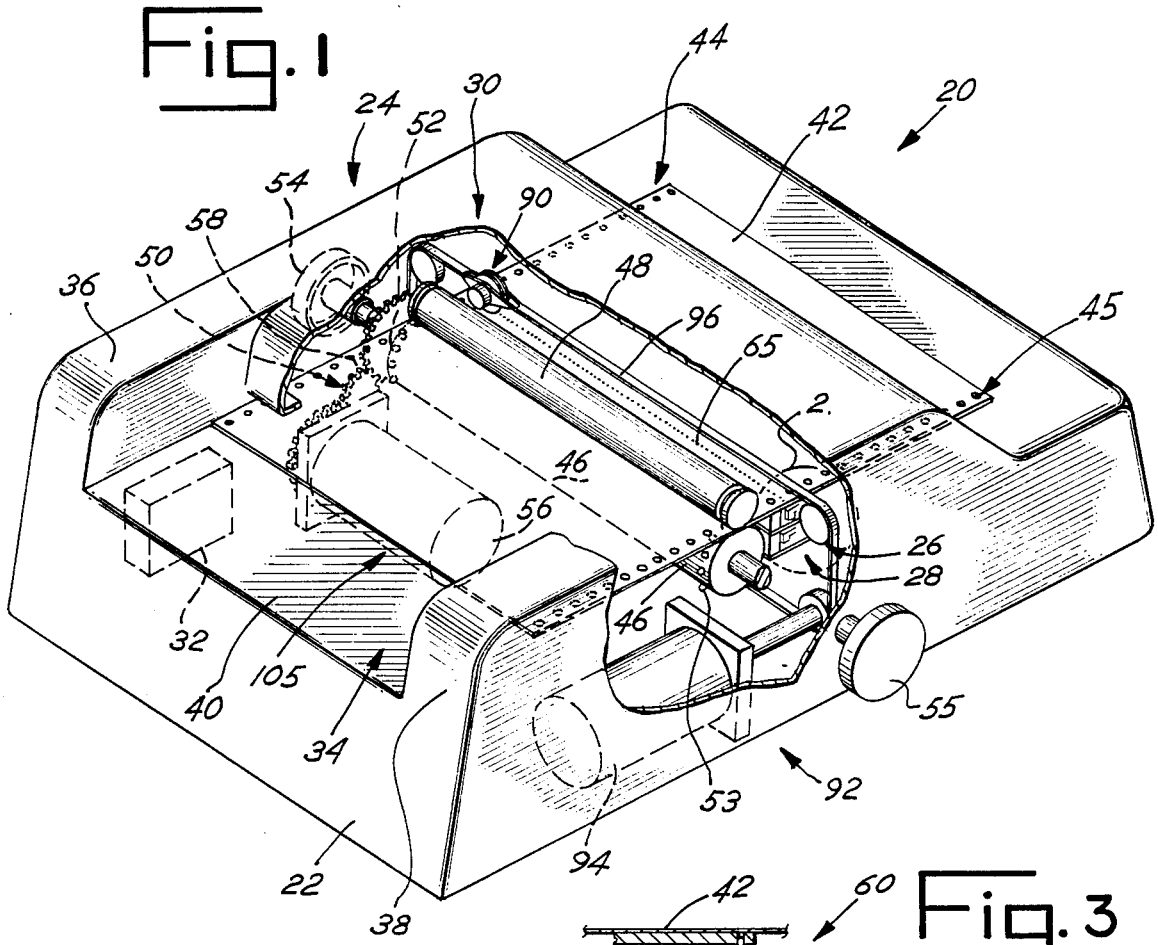
FIG. 1 is a perspective view, with a cut away portion, of a preferred embodiment of the present invention.

Referring to FIGS. 1–10, a preferred embodiment of the present invention is shown as an improved apparatus for making tactile impressions on paper. The apparatus hereafter shall be referred to as a "Braille printer" or "printer" 20. It is to be understood, however, that a number of alternative systems to communicate with the visually handicapped, which employ tactile impressions on paper, may be used with the present invention.

The Braille system uses series of raised dots. Other types of tactile markings, such as, for example, raised slashes or other geometric patterns, may be made on paper with the present invention. The invention may be modified to accommodate different types of raised characters or different arrangements of raised characters to represent various letters, words, or thoughts.

The Braille printer 20 includes a housing 22, paper receiver 24, plurality of pins 26, driver assembly 28, print wheel or platen assembly 30, and controller 32. The housing 22 is made of plastic and substantially encloses the other components of the printer 20. The housing 22 includes a paper slot 34, defined by two side ridges 36, 38, and a lower horizontal plate 40. The paper slot 34 defines the "front" of the printer 20. For illustrative purposes, a sheet of fan-fold computer paper 42 is shown in the printer 20 in FIG. 1. The paper 42 includes a series of side holes 44, 45 therein. Such computer paper, as well as other types of paper (including "used" paper with ink printing on it) may be used with the present printer 20.

Paper Receiver 24

The paper receiver 24 includes a platen 46, roller 48, and paper advance mechanism 50. The platen 46 and roller 48 are spaced apart so that the paper 42 may snugly fit between them. Each end of the platen 46 includes a series of pegs 52, 53 and a knob 54, 55. The pegs 52, 53 mesh with the series of holes 44, 45 along the sides of the paper 42. For paper not including such holes, however, the simple friction of the paper between the platen 46 and roller 48 is sufficient to hold the paper in the desired location while the printer 20 is in operation.

The knobs 54, 55 on each end of the platen 46 may be turned to manually advance the paper 42. To load the printer 20 with paper, the paper 42 is placed in the paper slot 34 and pushed forward toward the platen 46 and roller 48.

The paper advance mechanism 50 includes a stepper motor 56, interconnected via an interface in the form of a gear assembly 58, to the platen 46. Upon receiving a signal from the controller 32, the mechanism 50 rotates the platen 46 and moves the paper 42.

Pins 26

Figure 3:
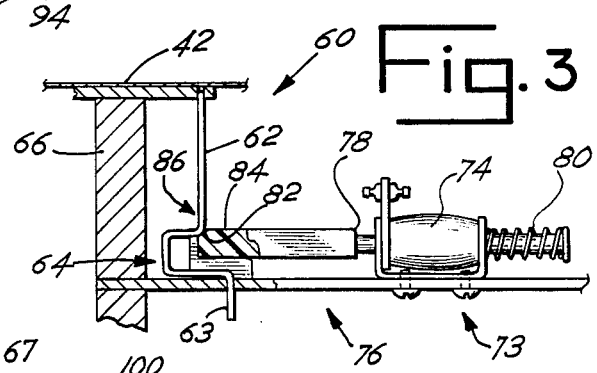
FIG. 3 is a right side view of a portion of the driver assembly shown in FIG. 2, with a pin in a normal, retracted position.
Figure 4:
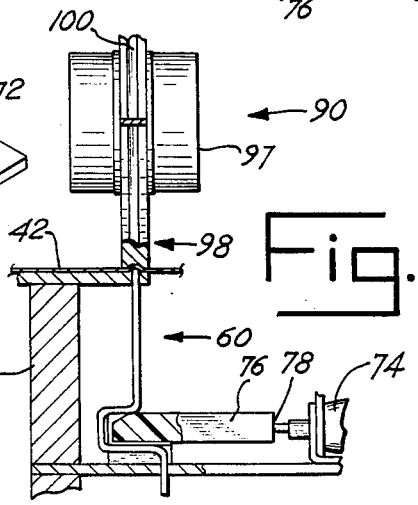
FIG. 4 is a right side view of a portion of the driver assembly shown in FIG. 2, with the pin in an extended position.
Figure 5:
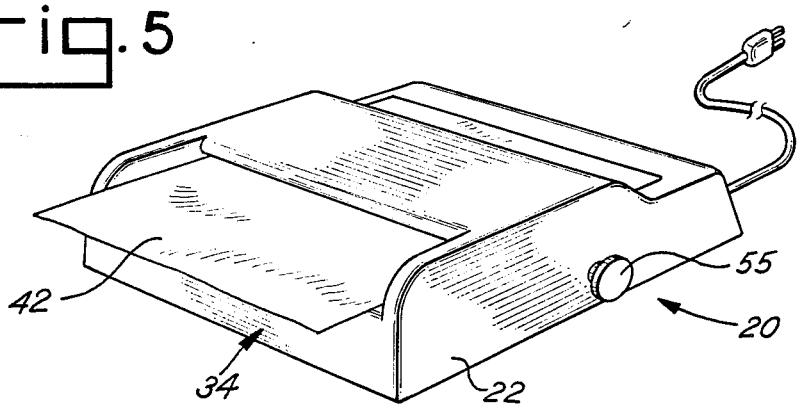
FIG. 5 is a perspective view of the preferred embodiment shown in FIG. 1.

The pins 26 of the printer 20 are combined into groups of forty pairs. Since all of the eighty pins are substantially the same, only a single, illustrative pin 60 is discussed immediately below. The pin 60 includes upper and lower segments 62, 63, which are substantially straight, and a curved elbow portion 64, as shown in FIGS. 3 and 4. The upper and lower segments 62, 63 of the pin 60 are approximately 10 millimeters in diameter. The top of the upper segment 62 is rounded. All of the pins 26 are arranged substantially in a straight line near the platen 46. This line defines the "roller path" 65 of the printer 20.

Driver Assembly 28

The driver assembly 28 includes a bracket 66 holding a series of forty pairs of drivers 67. The drivers 67 comprise a group of eighty electrical solenoids 68 and a group of eighty interface blocks 70. See FIG. 2.

The bracket 66 is interconnected to the housing 22 and is substantially adjacent to the platen 46. When the printer 20 is in its normal position, as shown in FIG. 1, the solenoids 68 are in a substantially horizontal orientation, and the pins 26 are held by the bracket 66 in a substantially vertical position.

Figure 2:
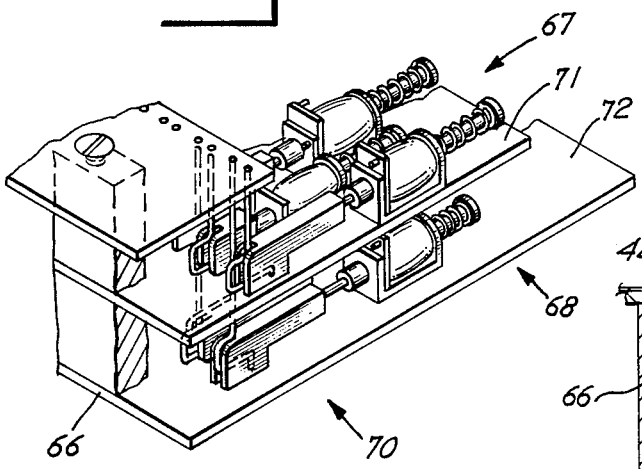
FIG. 2 is an enlarged perspective view of a portion of the driver assembly in the preferred embodiment shown in FIG. 1.

The bracket 66 includes upper and lower levels 71, 72, as shown in FIG. 2. With this arrangement, each of the forty pairs of pins 26 may be located closely to one another (despite the physical width of the solenoids 68).

Since all of the eighty driver assemblies 67 are substantially the same, only a single, illustrative driver 73, a single, illustrative electrical solenoid 74, and single illustrative interface block 76 are discussed below. The solenoid 74 is attached to the bracket 66 and includes a central shaft 78 and retracting spring 80. The spring 80 normally keeps the shaft 78 in a retracted position, as shown in FIG. 3. The block 76 is interconnected to the shaft 78 and, as shown, includes an inclined surface, 82, having an angle of approximately 30 degrees to horizontal, and an upper surface 84, which is substantially horizontal. The solenoid 74 moves the central shaft 78 approximately 0.2 inch upon receiving an electrical impulse.

The elbow portion 64 of the pin 60 rests against the inclined surface 82 of the block 76. The elbow portion 64, together with the inclined surface 82, define cooperating cam surfaces 86. See FIG. 3. Thus, when the solenoid 74 is activated and the block 76 is pushed toward the pin 60, the elbow portion 64 of the pin 60 slides upward, along the inclined surface 82 and then finally to the upper surface 84 of the block 76. See FIG. 4. The elbow portion 64 then rests on the upper surface 84 until the solenoid 74 releases the shaft 78 and the spring 80 pushes the shaft 78 back into the normal position, allowing the pin 60 to fall back to the normally retracted position shown in FIG. 3.

In operation, the solenoids 68 are activated such that a selected group of the pins 26 are driven approximately 1/32 inch above the paper slot 34. While in the upper position, the elbow portion 64 rests on the upper surface 84 of the block 76, and the pin 60 can not be depressed by applying a normal, downward pressure on the pin 60. The pin 60 is effectively "locked" in the elevated position, as shown in FIG. 4.

Accordingly, the wheel assembly 30 presses downward, forcing the paper 42 against the extended pin 60. When the print wheel assembly 30 presses paper over the pin 60, the pin 60 leaves a tactile impression on the paper 42.

Print Wheel Assembly 30

Figure 6:
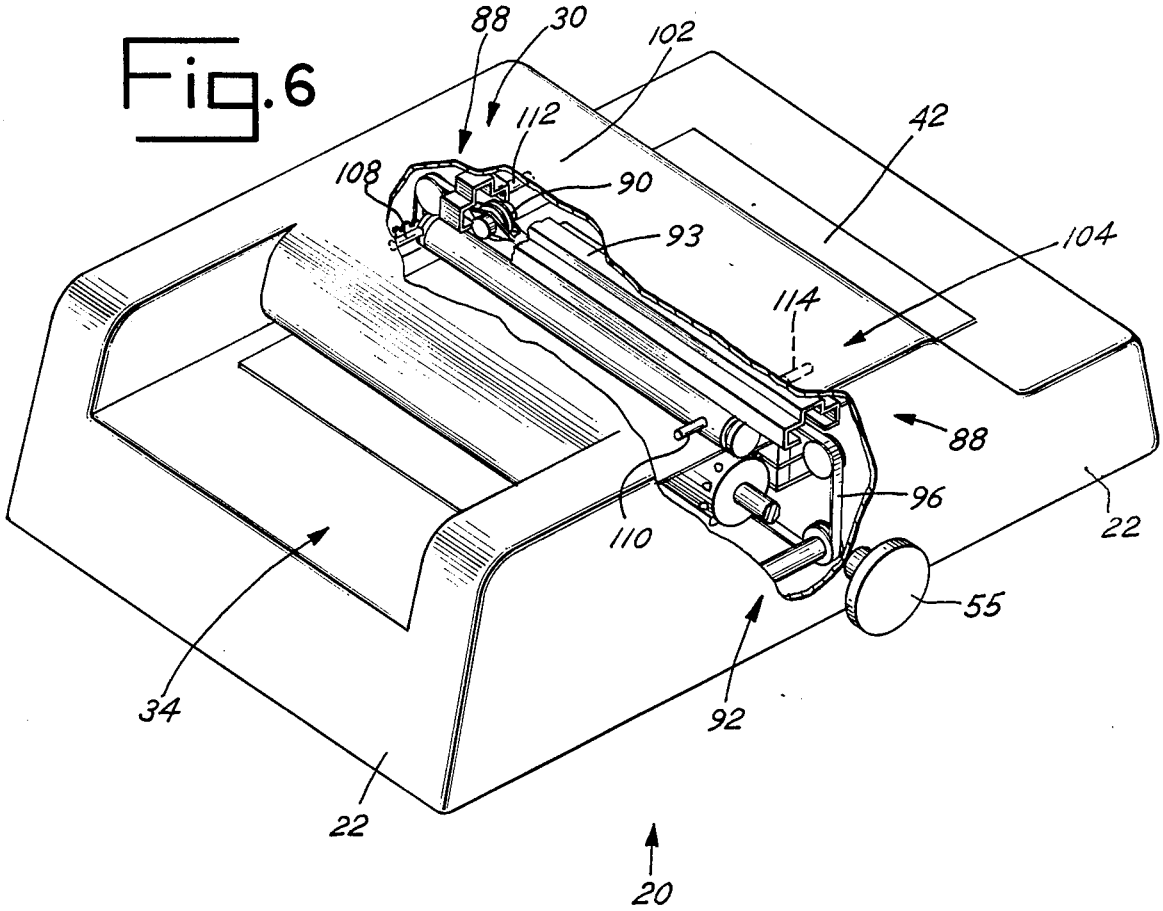
FIG. 6 is a partial perspective view of the preferred embodiment shown in FIG. 1, with a cut away portion showing the channel and optical scanner assembly.
Figure 8:
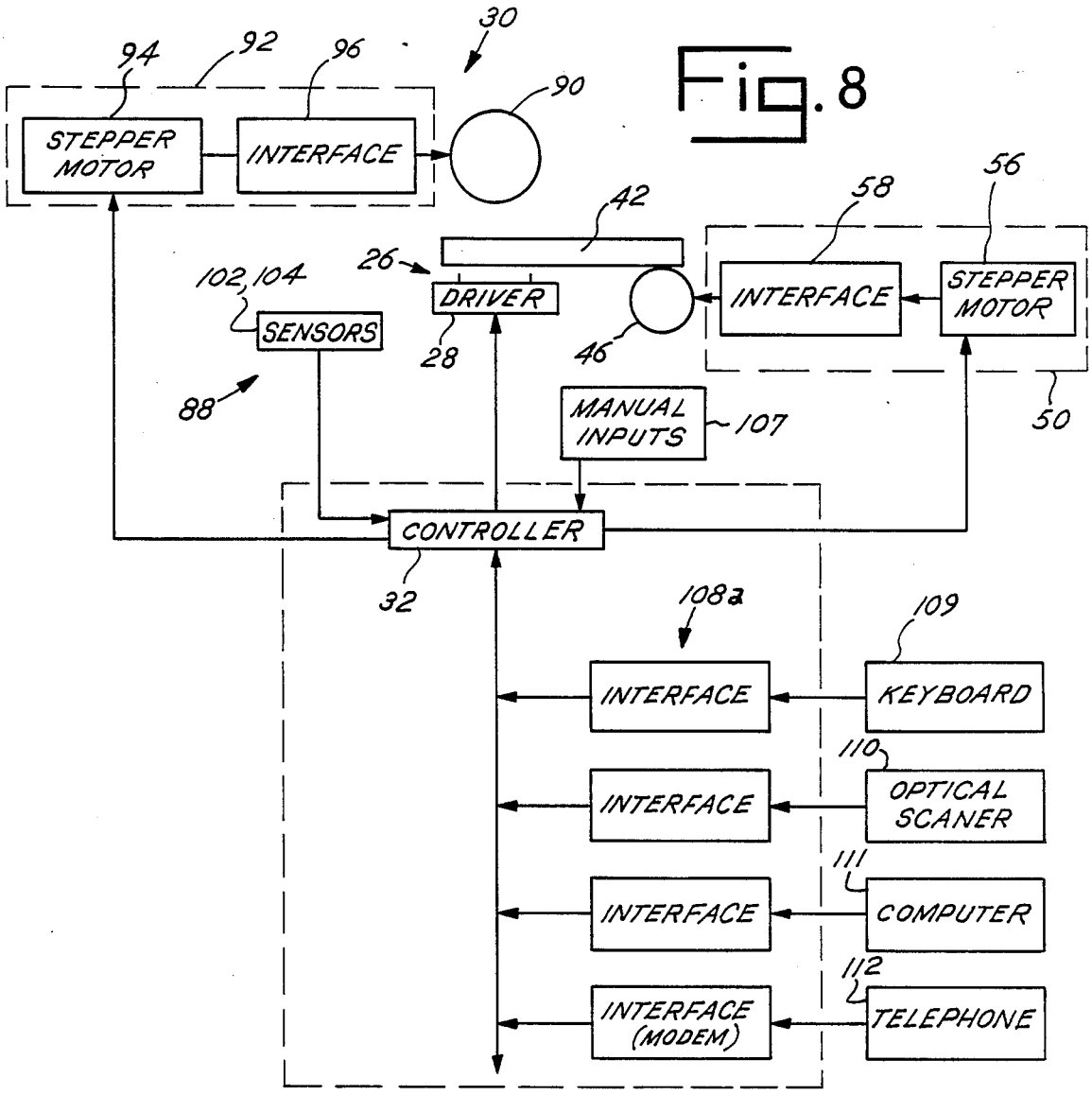
FIG. 8 is a more detailed block diagram of the preferred embodiment shown in FIG. 7.
Figure 7:
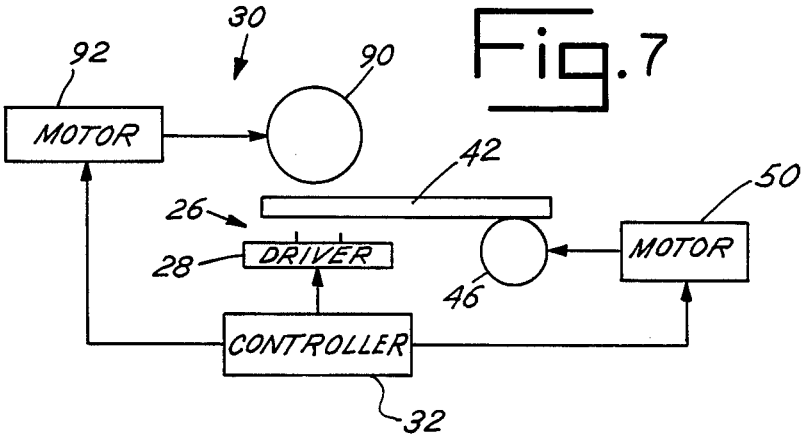
FIG. 7 is a simplified block diagram of the preferred embodiment shown in FIG. 1.

As shown in FIGS. 1 and 6, the print wheel assembly 30 includes a sensor assembly 88, print wheel or platten 90, drive mechanism 92, and channel 93. The drive mechanism 92 includes a reversible stepper motor 94, as shown in FIG. 1, and an interface, in the form of an endless belt 96 attached to the print wheel 90, as shown in FIG. 6. The stepper motor 94 receives commands from the controller 32 and responsively turns the endless belt 96, allowing the print wheel 90 to roll along the roller path 65.

The print wheel or platten 90 is approximately one inch in diameter, having a rotatable central spindle 97 and a circumferential edge 98. See FIG. 4. In the preferred embodiment, the circumferential edge 98 includes an elastomeric rim 100, approximately ¼ inch thick. Thus, when the wheel 90 rolls along the roller path 65, the wheel 90 pushes the paper 42 about the raised pin 60, and the pin 60 extends into the paper 42 and into the elastomeric rim 100 of the wheel, as shown in FIG. 4. Accordingly, a raised dot appears on the paper 42, which corresponds to the raised pin 60. Where the pin 60 has not been raised, however, the wheel 90 simply rides over the paper 42 without causing any raised dots to be made in the paper 42.

As shown by FIGS. 1 and 6, the channel 93 is located directly above the roller path 65. The channel 93 is rigid and fixedly attached to the housing 22. As shown in FIG. 6, the channel 93 allows the print wheel 90 to move unobstructed, but resists upward movement of the wheel 90, away from the paper 42.

In this way, when the wheel 90 rides over a raised pin, the wheel 90 does not ride upward over the pin. Rather, the spindle 97 of the print wheel 90 remains at a substantially constant distance above the paper slot 34, regardless of whether a pin has been raised. The wheel 90 riding over a raised pin simply pushes the paper about the pin, rather than moving the wheel 90 and spindle 97 upward.

The sensor assembly 88 includes two head detectors 102, 104, a paper sensor 105, a buzzer 106, and manual inputs 107. See FIGS. 6, 8, and 10C. The head sensors 102, 104 are mounted on either end of the-roller path 65. Each of the sensors 102, 104 includes a source of light 108, 110 and a light detector 112, 114.

When the print wheel 90 is in the center of the printer 20, away from either end of the roller path 65, each source 108, 110 sends an unobstructed beam of light to a corresponding light detector 112, 114. When the wheel 90 reaches one end of the roller path 65, however, the wheel 90 obstructs the light. The detector 112, 114 then sends a signal to the controller 32. The controller 32 may then responsively adjust the movement of the drive mechanism 92 so that the wheel 90 will not be substantially further driven toward the end, but will either stop or reverse direction.

Of course, alternative embodiments of the printer 20 may include, for example, instead of the sensors 102, 104, any of a variety of simple limit switches Such limit switches could sense the passage of the print wheel 90 and, accordingly, signal the controller 32.

The paper sensor, or button 105, is located along the paper slot 34. The sensor, or button, 105 is depressed only if there is paper in the paper slot 34. When a fault condition exists, such as, for example, the print wheel 90 does not rotate or the paper is out, the controller 32 issues an alarm signal to the buzzer 106. The buzzer 106 responsively sounds an audible alarm to alert the user of the fault condition. The manual inputs 107 allow the user to push a button and instruct the controller 32 to advance the paper one page or one line or to go "on or off line."

During operation, the printer 20 may receive an input from a variety of interfaces 108*a*, which receive signals from a variety of sources, such as, for example, a keyboard 109, optical scanner 110, computer 111, or telephone line 112. See FIG. 8. The controller 32 receives such signals and responsively issues signals to the driver assembly 28 and print wheel assembly 30.

The print wheel assembly 30 advances the paper 42 at a controlled rate, and the reversible stepper motor 94 responsively moves the print wheel 90 over the roller path 65. The controller 32 sends signals to the driver assembly 28 so that appropriate pins are extended. Consequently, the electrical input signals are transformed to a understandable sequence of raised dots as the paper 42 is fed through the printer 20 by the stepper motor 56. See FIGS. 7 and 8.

Controller 32

In the preferred embodiment, the controller 32 includes a direct (d.c.) current power supply 116 and interface 118. Schematic representations of the controller 32 are shown in FIGS. 9 and 10.

Figure 9:
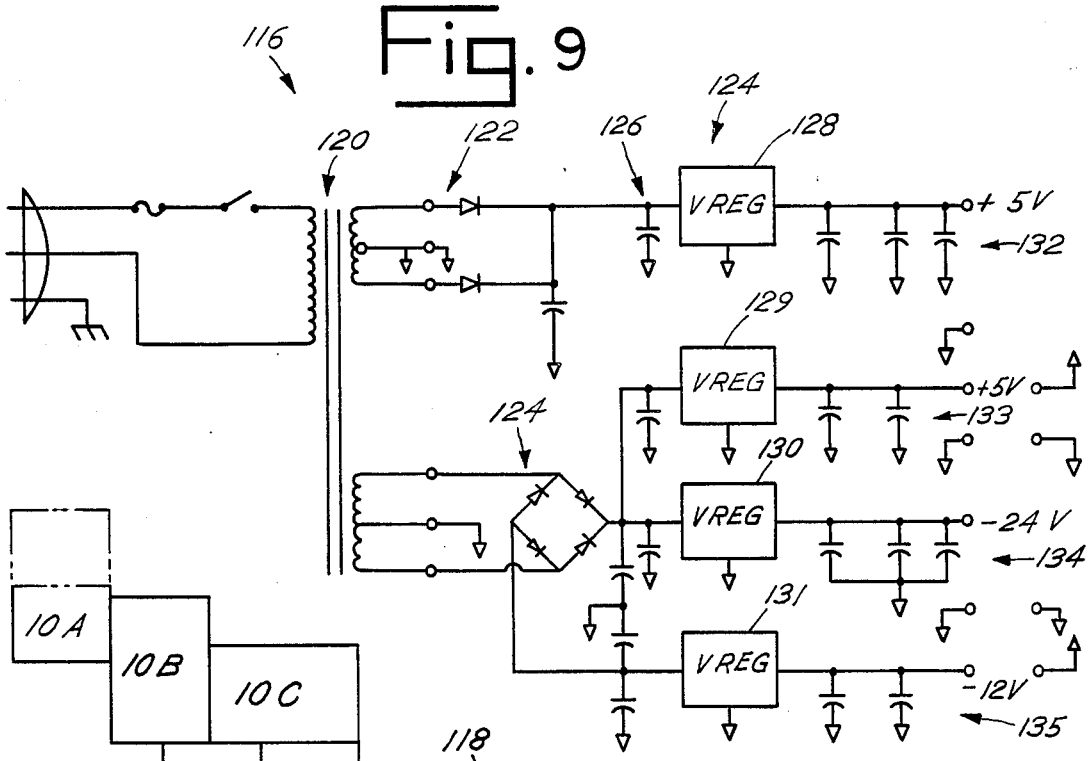
FIG. 9 is a schematic diagram of the direct current power supply for the controller in the preferred embodiment shown in FIG. 1.

FIG. 9 shows the power supply 116 used to provide constant source of direct current electrical power to the other components of the printer 20. The power supply 116 includes a line voltage input transformer 120, two rectifiers 122, 124, six input smoothing capacitors 126, four voltage regulators 128, 129, 130, 131, and ten output smoothing capacitors 132, 133, 134, 135. The transformer 120 provides alternating current (a.c.) voltage to the rectifiers 122, 124 and to the smoothing capacitors 126. Accordingly, a low voltage d.c. current is provided to the voltage regulators 128–131.

The voltage regulator chips 128–134 provide, respectively, a substantially constant source of +5 Volts (10 ampere maximum), +5 Volts (1 ampere maximum), +24 Volts (5 ampere maximum) and −12 Volts (1 ampere maximum) for use by the other components in the rest of the controller 32. The output smoothing capacitors 132–135 help to maintain the voltage output of the voltage regulator chips 128–131 at a more constant level.

Figure 10:
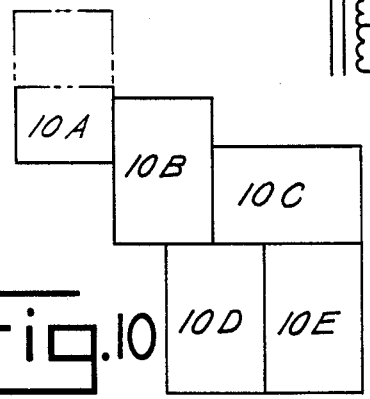
FIG. 10 is a schematic diagram of the interface for the controller in the preferred embodiment shown in FIG. 1.
Figure 10A:
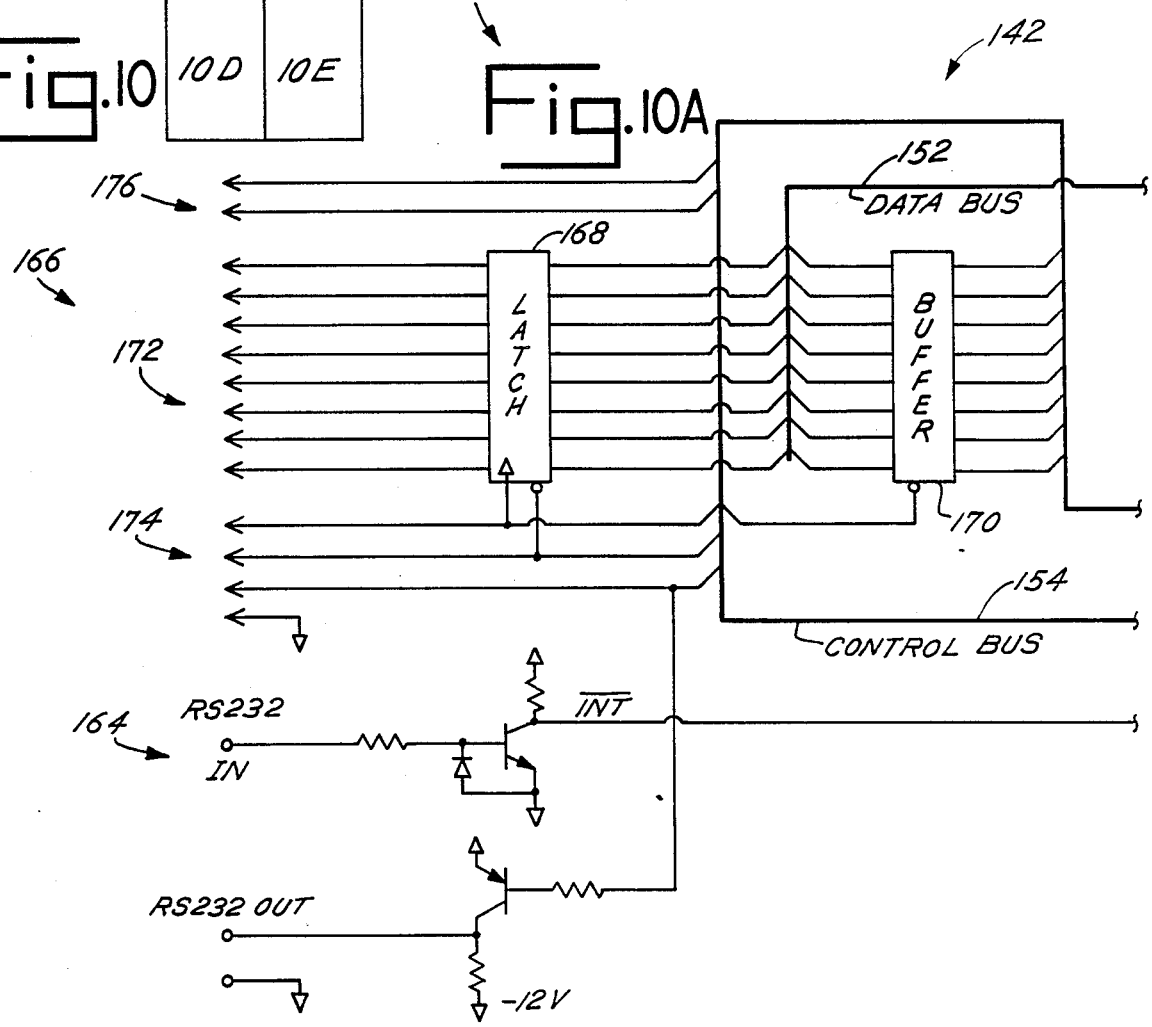
Figure 10B:
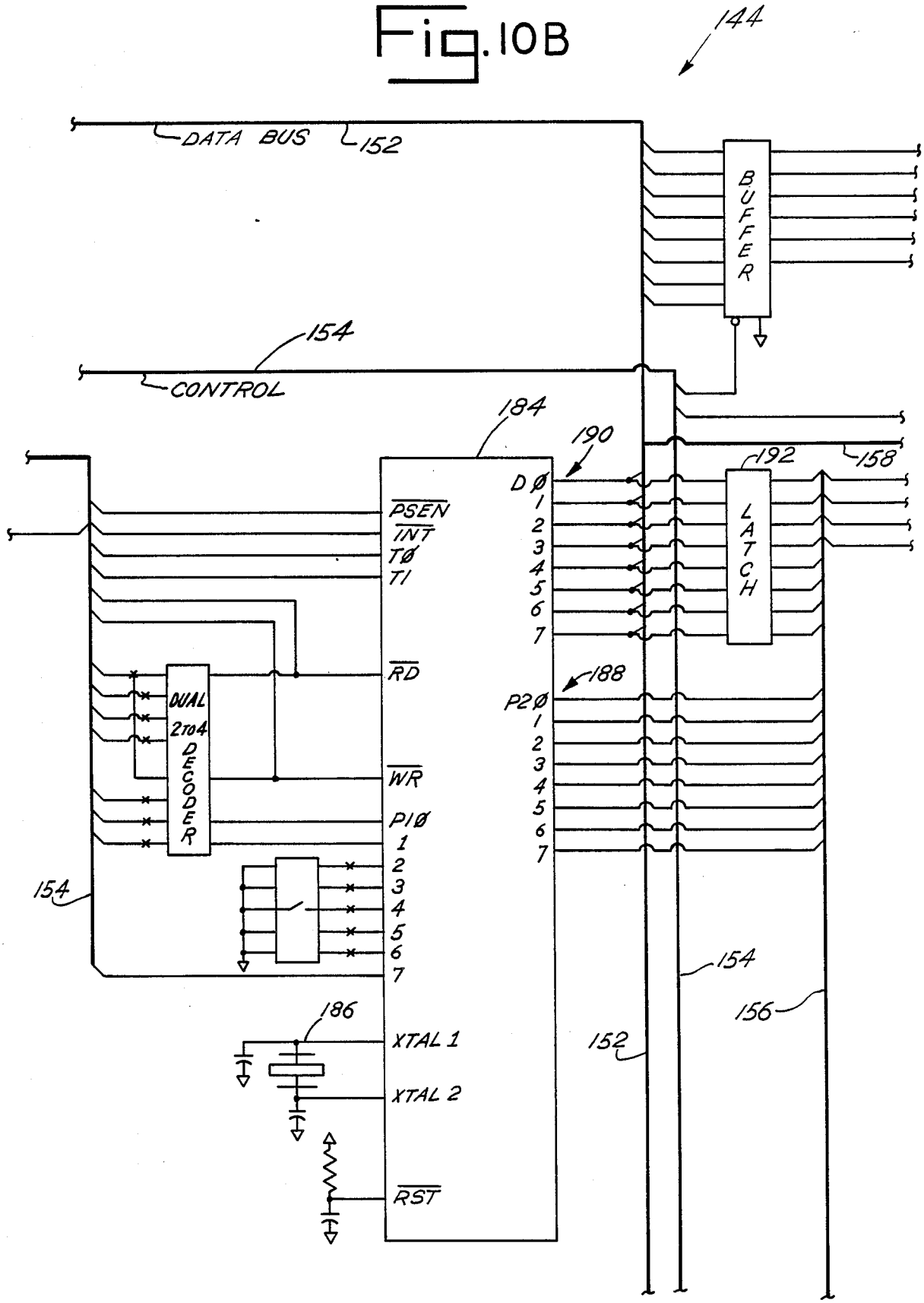
Figure 10C:
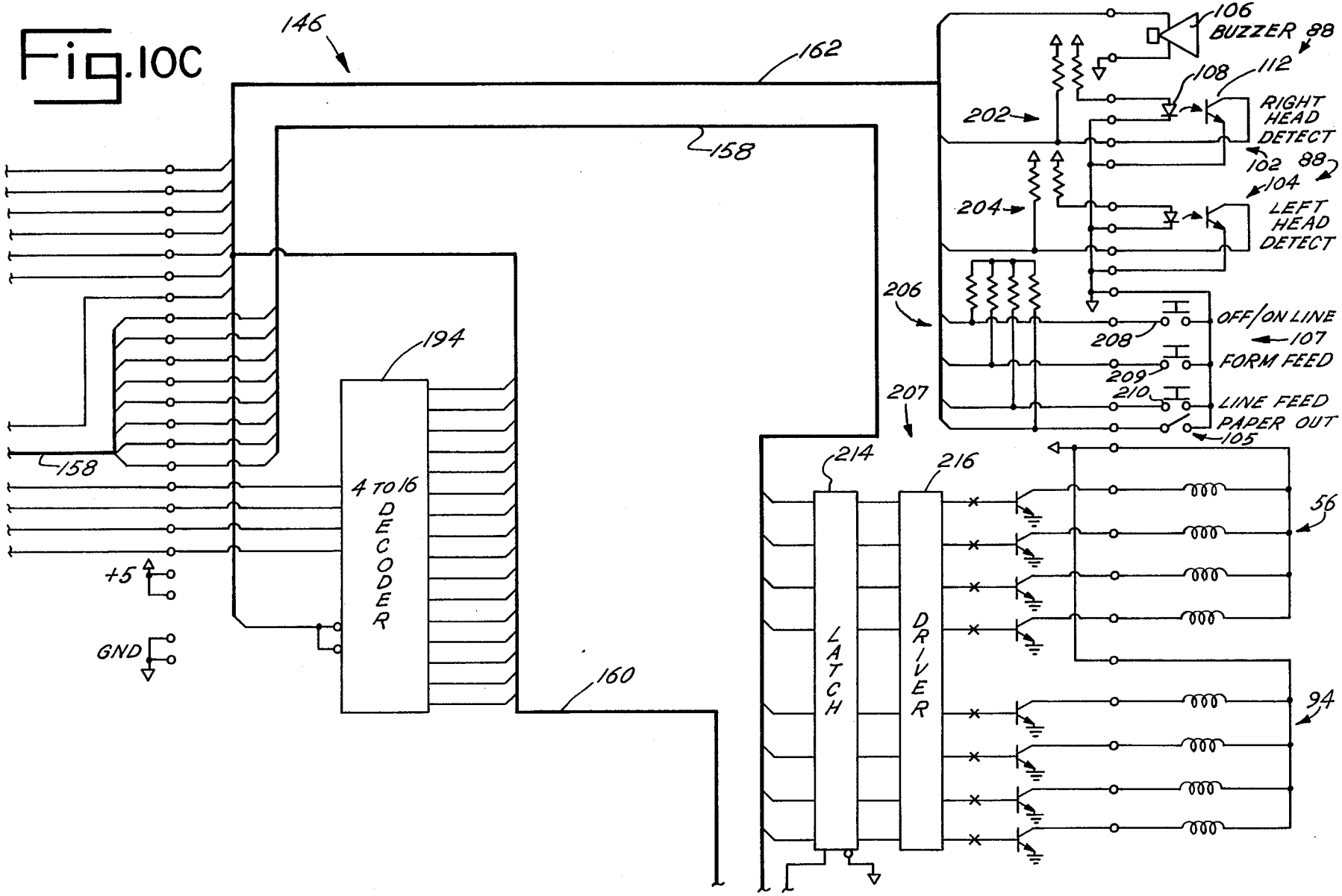
Figure 10D:
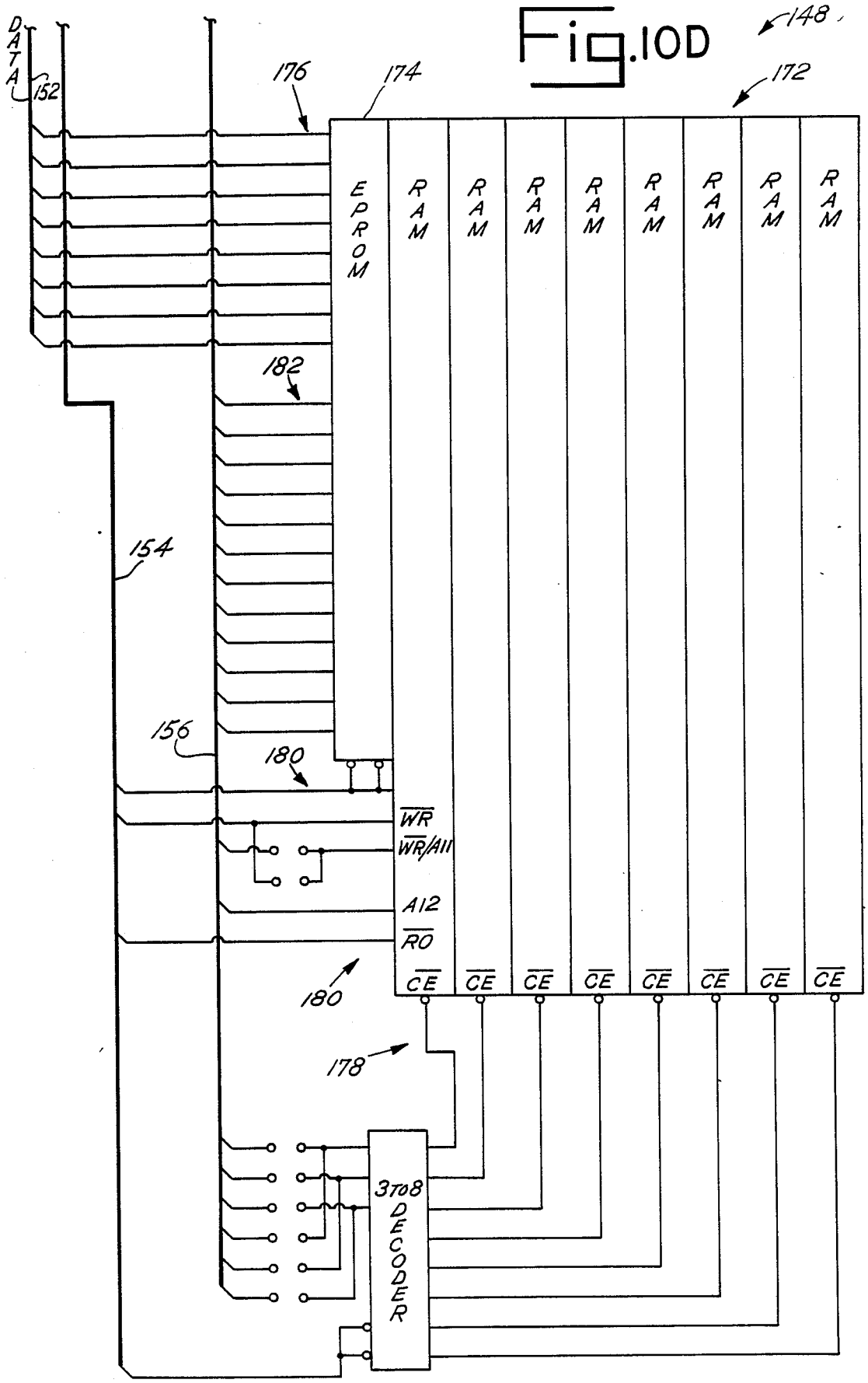
Figure 10E:
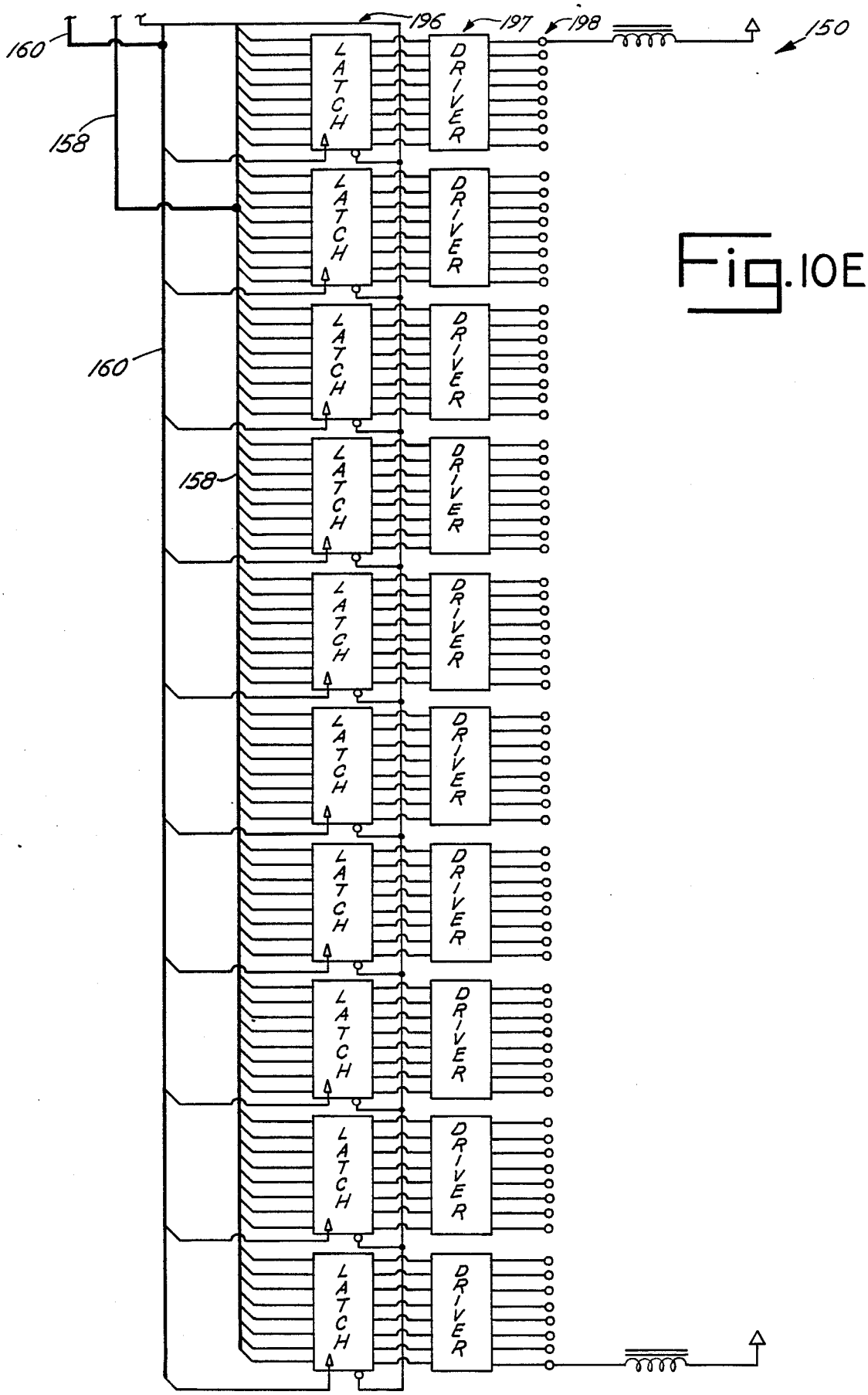

FIG. 10 discloses the interface 118 for the printer 20, which includes an input circuit 142 (FIG. 10A), microprocessor circuit 144 (FIG. 10B), paper control circuit 146 (FIG. 10C), memory circuit 148 (FIG. 10D), and driver circuit 150 (FIGS. 10C and 10E). The circuits are interconnected via a data bus 152, control bus 154, address bus 156, driver bus 158, output control bus 160, and print control bus 162.

Input Circuit 142 (FIG. 10A)

The input circuit 142 includes a standard RS232 data port 164, to receive serial data, and parallel input lines 166, to receive parallel data. The parallel input lines 166 include eight input lines 172 to receive Centronics parallel input, four "hand shaking" lines 174, and two error signaling lines 176. The hand shaking lines 174 allow proper sequencing of the information along the eight input lines 172.

Data from the eight input lines 172 are received by the latch 168. The latch 168 responsively holds the received signals, while forwarding signals to the data bus 152 and buffer 170. The "hand shaking" lines 174 are interconnected to the control bus 154.

The buffer 170 receives the signals from the latch 168. If the input is arriving too quickly and the buffer 170 becomes full, the buffer 170 sends a signal, via one of the "hand shaking" lines 174, to inform the transmitting interface that no additional data should be sent until a clear signal is sent along the "hand shaking" lines 174.

Memory Circuit 148 (FIG. 10D)

Data from the buffer 170 is transferred to the memory circuit 148 via the data bus 152. The memory circuit 148 includes a 64K Random Access Memory (RAM) 172 as well as an Erasable Programable Read Only Memory (EPROM) 174 which holds a microprocessor program. The memory circuit 148 also includes memory data lines 176, address input lines 178, control lines 180, and address control lines 182. Data from the buffer 170 is sent via the memory data lines 176 and RAM 172.

Microprocessor Circuit 144 (FIG. 1OB)

The microprocessor circuit 144 advises the RAM 172 of where the data is to be stored, via the address bus 156 and address input lines 178. The EPROM 174 sends signals to control the operation of the microprocessor circuit 144 via the control lines 180. The location of data to be retrieved is sent via the address control lines 182. As needed, data from the RAM 172 is supplied to the microprocessor circuit 144, according to the instructions in the EPROM 174, via the memory data lines 176.

The microprocessor circuit 144 in the preferred embodiment includes an Intel 8049 microprocessor 184 with standard peripheral circuits, such as an eight megahertz crystal-driven clock 186, address output lines 188, data lines 190, and an output latch 192.

The microprocessor and memory circuits 144, 148 function, in essence, as a "look up table." In accordance with the data received, the controller 32 determines what series of impressions should be made on the next line of paper and, accordingly, sends appropriate signals to the driver assembly 28 so that an appropriate pattern of raised dots or characters will be made on the paper.

The microprocessor 184 sends signals, via the address output lines 188 and address bus 156, to control where data is stored in the memory circuit 148 The output of the microprocessor 184, which contains information as to which pins should be elevated to cause a proper sequence of raised dots on the paper 42, is sent out, via the data lines 190, to the latch 192. The latch 192, in turn, sends the data to the address bus 156 and the driver circuit 150.

Driver Circuit 150 (FIGS. 10C and 10E)

The driver circuit 150 includes a 4 to 16 decoder 194 (FIG. 10C), ten latches 196 (FIG. 10E), and ten solenoid drivers 197 (FIG. 10E). Data from the latch 192 are thus sent to the 4 to 16 decoder 194 which, in turn, transmits the output from the microprocessor 184 to the output control bus 160.

Each of the ten latches 196 receives ten inputs: eight from the driver bus 158, one from the output regulation bus 160, and one from the paper control circuit 146. Each of the ten latches 196 provides eight output lines. Each of the ten solenoid drivers 197 receives the eight output lines from one of the latches 196 and provides eight output lines 198. Each of the 80 output lines 198 is connected to one of the solenoids 68, such as the solenoid 74 shown in FIG. 3. The solenoid, in turn, when activated, pushes a pin upward against the paper.

As required, the microprocessor 184 sends signals along the print control bus 162 to activate the stepper motor 56 or the reversible stepper motor 94 to either move the print wheel 90 along the paper roller path 65 or to advance the platen 46 and thus the position of the paper 42 within the printer 20.

Paper Control Circuit 146 (FIG. 10C)

The paper control circuit 146 includes the buzzer 106, right head detect circuit 202, left head detect circuit 204, printer control circuit 206, and motor drive circuit 207. The right and left head detect circuits 202, 204 receive signals from the light sensors 102, 104 and responsively issue a signal to the microprocessor 184, along the print control bus 162, when the print wheel 90 has reached an end of the roller path 65.

The printer control circuit 206 includes a off/on line switch 208, form feed switch 209, and line feed switch 210, as well as the paper-out switch 105. When activated, each switch 105, 208–210 delivers a signal to the microprocessor 184, via the print control bus 162. The switches 105, 208–210 send signals to note that the printer 20 is off or on line, to activate the stepper motor 56 to advance the paper 42 an entire sheet, to activate the stepper motor to advance the paper 42 one line, and to note that no paper is in the paper slot 34. In respcnse to a signal from the paper-out switch 105 or other fault conditions, the microprocessor 184 issues a signal to activate the buzzer 106 and thus advise the user that a fault conditions exits.

The motor drive circuit 207 includes a latch 214 and driver 216. Upon receiving a signal from the microprocessor 184, the latch 214 or 216 responsively activate the motors 56, 94.

Although the foregoing description of the preferred embodiment will enable a person of ordinary skill in the art to make and use the invention, the following detailed assembly language listing for the microprocessor 184 is included. The listing provides detailed information concerning the overall programming and operation of the controller 32. Additional features of the controller 32 will become apparent to those skilled in the art upon reviewing the assembly language listing that follows.

```
AVOCET SYSTEMS 8048 CROSS-ASSEMBLER -  VERSION 1.64

SOURCE FILE NAME: BRAILLE.ASM


0000            ERROR   EQU     0

                ;
                ; COPYWRITE 1987 BY W.I.S.E. & TRL
                ;
                ;           REVISION 0
                ;
                ;              by
                ;
                ;         THOMAS R. LUCK
                ;
                ;        April 7th, 1987
                ;
                ; R E G E S T E R S

                ;         BANK 0                BANK 1
                ;
                ; R0
                ; R1
                ; R2                            FLAG TIMER
                ; R3    TEMP
                ; R4    TEMP
                ; R5
                ; R6    ROW
                ; R7    LINE COUNTER
                ;
                ;       REGISTERS EQUATES

                ; LOC 0-7       RB0
                ;     8-23      STACK
                ;    24-31      RB1

0A00            REG0    EQU     R0
0058            BUFFER  EQU     58H
0080            BUFTOP  EQU     80H
```

```
0020        LATCH    EQU     20H
0021        LCHP     EQU     21H
0022        VALUE    EQU     22H
0023        MASK     EQU     23H
0024        SAVE     EQU     24H
0025        MEMIN0   EQU     25H
0026        MEMIN1   EQU     26H
0027        MEMOUT0  EQU     27H
0028        MEMOUT1  EQU     28H
0029        BUFPNT   EQU     29H
002A        PSTATUS  EQU     2AH
002B        PSWST    EQU     2BH
002C        ACCTIM   EQU     2CH
002D        ACCEXT   EQU     2DH
002E        OUTOR    EQU     2EH
002F        MODE     EQU     2FH          ; 0-LETTER 1-COMPUTER
            2-FINACIAL
0030        PRMODE   EQU     30H          ; 0-NORM 40H-CAPS 80H-
            NUMBERS
0031        LINENO   EQU     31H
0032        ESC      EQU     32H          ; LAST CHARACTER WAS A
            N ESC
0033        R4SAVE   EQU     33H

0020        FORML    EQU     20H          ; NUMBER OF LINES PER
            PAGE

0046        MEMTS0   EQU     46H
0047        MEMTS1   EQU     47H
0048        MEMTS2   EQU     48H
0049        MEMTS3   EQU     49H
004A        MEMTS4   EQU     4AH


            ;
            ;        P1 PORT
            ;
            ;        D7 Serial Output

            ;        D2,3,4,5,6 Switch Input
0000
            ;        D0,1

            ;                 Input                    Output
            ;        00       Memory                   Memory
            ;        01       Parallel AKN
            ;        10       Buffer In
            ;        11       Expansion In             Expansion Out
007C        SW       EQU     7CH
007C        MEMSEL   EQU     0+SW
007D        CDATAIN  EQU     1+SW
007E        INPUT    EQU     2+SW
007F        INPUT0   EQU     3+SW

007D        OUTPUT   EQU     1+SW
007E        OUTPUT0  EQU     2+SW
007F        CDATAO   EQU     3+SW

            ; MEMORY EQUATES

0001        MEMTOP   EQU     1H       ; REM * * 20H

            ; OUTPUT EQUATES
```

```
0005        PUNCH0   EQU     5
0006        PUNCH1   EQU     6
0003        PUNCH2   EQU     3
0002        PUNCH3   EQU     2
0001        PUNCH4   EQU     1
0000        PUNCH5   EQU     0
0009        PUNCH6   EQU     9
0008        PUNCH7   EQU     8
0007        PUNCH8   EQU     7
0004        PUNCH9   EQU     4

000A        RESET    EQU     10
0000
            ; L3 L2 L1 L0 H3 H2 H1 H0

000B        STEPPER EQU      11
000A        STEP0    EQU     00AH
0006        STEP1    EQU     006
0005        STEP2    EQU     005
0009        STEP3    EQU     009
000F        STEP4    EQU     00FH
00F0        STEP     EQU     0F0H

00A0        LSTEP0   EQU     0A0H
0060        LSTEP1   EQU     060H
0050        LSTEP2   EQU     050H
0090        LSTEP3   EQU     090H
00F0        LSTEP4   EQU     0F0H
000F        LSTEP    EQU     00FH

            ; INPUT EQUATES

0001        RH       EQU     1
0002        LH       EQU     2
0004        POSW     EQU     4
0008        FFSW     EQU     8
0010        LFSW     EQU     10H
0020        OFFLSW   EQU     20H

            ; OUTPUT 0 EQUATES

            ;CERROR EQU      1
            ;CBUSY   EQU     2
            ;CPE     EQU     4
0008        BUZZER   EQU     8
            ;CNBUSY EQU      10H

            ; PRINTER STATUS

            ;        7 - OFF LINE = 1
            ;
            ;

0080        OFFLINE EQU      80H

0080        BUSY     EQU     80H
0000        NBUSY    EQU     0H
FFF2        BAUD     EQU     -14          ; 1200 BAUD 8 MHZ ROCK
FFF9        BAUD2    EQU     -7

0004        TESTSW   EQU     4
```

```
0008          BS       EQU     8
000D          CR       EQU     0DH
000A          LF       EQU     0AH

0000          NORM     EQU     00H
0040          CAPS     EQU     40H
0080          NUMB     EQU     80H
00C0          SPEC     EQU     0C0H

003A          NUMSIGN  EQU     3AH
0020          CAPSIGN  EQU     20H


0000                   ORG     0
0000 0412              JMP     START

0002                   ; EXTERNAL INTERRUPT VECTOR
0003                   ORG     3
0003 243E              JMP     FIFOIN

0005                   ; TIMER INTERRUPT VECTOR

0005                   ; USES

0005                   ; RB1 R7 = ACCUMALTOR SAVE

0005                   ; RB0 R2 = INTERUPT TIMER DONE


0007                   ORG     7
0007 D5       TIMER    SEL     RB1
0008 BAFF              MOV     R2,#0FFH
000A AF                MOV     R7,A
000B 23F2              MOV     A,#BAUD
000D 62                MOV     T,A
000E FF                MOV     A,R7
000F 55                STRT    T
0010 25                EN      TCNTI
0011 93                RETR


              ; POWER UP UNIT

0012 23FD     START    MOV     A,#OUTPUT+BUSY          ; BUSY
0014 39                OUTL    P1,A

0015 B90A              MOV     R1,#RESET
0017 91                MOVX    @R1,A                   ; RESET ALL SO
              LONOIDS
0018 91                MOVX    @R1,A                   ; RESET ALL SO
              LONOIDS

0019 B92A              MOV     R1,#PSTATUS
001B B100              MOV     @R1,#0                  ; SET FOR ON L
              INE

001D 74BC              CALL    SELOUT
001F B90B              MOV     R1,#STEPPER
0021 23FF              MOV     A,#STEP4+LSTEP4
0023 91                MOVX    @R1,A

0024 14FD              CALL    LEFT1
```

```
                ; CLEAR BUFFER

0026 B403               CALL    CLRBUF

0028 27                 CLR     A
0029 B92F               MOV     R1,#MODE
002B A1                 MOV     @R1,A           ; MODE
002C 19                 INC     R1
002D A1                 MOV     @R1,A           ; PRMODE
002E 19                 INC     R1
002F A1                 MOV     @R1,A           ; LINENO
0030 19                 INC     R1
0031 A1                 MOV     @R1,A           ; ESC

0032 B925               MOV     R1,#MEMIN0
0034 BC04               MOV     R4,#4
0036 27                 CLR     A
0037 A1         START0  MOV     @R1,A
0038 19                 INC     R1
0039 EC37               DJNZ    R4,START0

003B 74BC               CALL    SELOUT
003D B90A               MOV     R1,#RESET
003F 91                 MOVX    @R1,A                   ; RESET ALL SO
                LONOIDS

0040 35                 DIS     TCNTI
0041 23F2               MOV     A,#BAUD
0043 62                 MOV     T,A
0044 55                 STRT    T
0045 25                 EN      TCNTI
0046 05                 EN      I

0047 237D               MOV     A,#OUTPUT               ; SET PRINTER
                TO NOT BUSY

0049 39                 OUTL    P1,A
004A D5                 SEL     RB1
004B AE                 MOV     R6,A
004C C5                 SEL     RB0

004D 09                 IN      A,P1
004E 5304               ANL     A,#TESTSW
0050 0454               JMP     LOOP    ; REM * * JZ    LOOP

0052 84C0               JMP     TESTLP

                ; EXECUTIVE LOOP

0054 C400       LOOP    JMP     BUFFIN                  ; GET ANY CHAR
                ACTERS TO PRINT
0056 E654       LOOPXX  JNC     LOOP            ; REM * LOOP0

0058 9400               CALL    PRINT                   ; PRINT IF LIN
                E IS FULL ETC
005A 0454               JMP     LOOP

                ; CHECK FOR SWITCHES ETC

005C 74B4       LOOP0   CALL    SELINP
005E 81                 MOVX    A,@R1
005F 5304               ANL     A,#POSW                 ; CHECK FOR PA
                PER OUT
```

```
0061 C68F                JZ      PAPER

0063 B92A                MOV     R1,#PSTATUS              ; SEE IF OFF L
                 INE
0065 F1                  MOV     A,@R1

0066 5380                ANL     A,#OFFLINE
0068 C676                JZ      LOOPON
006A 81                  MOVX    A,@R1
006B 5308                ANL     A,#FFSW                  ; FORM FEED??
006D C6B6                JZ      FORM

006F 81                  MOVX    A,@R1
0070 5310                ANL     A,#LFSW                  ; LINE FEED??
0072 C6B8                JZ      LFEED

0074 0454                JMP     LOOP

0076 81          LOOPON  MOVX    A,@R1
0077 5320                ANL     A,#OFFLSW                ; SEE IF TIME
                 TO OFFLINE
0079 C680                JZ      OFFLINE
007B 0454                JMP     LOOP

007D 81                  MOVX    A,@R1
007E 5338                ANL     A,#OFFLSW+FFSW+LFSW      ; WAIT TILL SW
                 ITCHES ARE RELEASED
0080 37                  CPL     A
0081 C683                JZ      DEB

0083 BB00        DEB     MOV     R3,#0

0085 81          DEB0    MOVX    A,@R1
0086 5338                ANL     A,#OFFLSW+FFSW+LFSW      ; WAIT TILL SW
                 ITCHES ARE RELEASED
0088 37                  CPL     A
0089 C683                JZ      DEB
008B EB85                DJNZ    R3,DEB0
008D 0454                JMP     LOOP

008F D5          PAPER   SEL     RB1
0090 FE                  MOV     A,R6
0091 4380                ORL     A,#BUSY
0093 AE                  MOV     R6,A
0094 C5                  SEL     RB0
0095 39                  OUTL    P1,A

0096 74C4        PAPERH  CALL    SELOUT1
0098 2308                MOV     A,#BUZZER
009A 90                  MOVX    @REG0,A
009B 27                  CLR     A
009C AB                  MOV     R3,A
009D AC                  MOV     R4,A

009E EB9E        PAPER1  DJNZ    R3,PAPER1
00A0 EC9E                DJNZ    R4,PAPER1

00A2 27                  CLR     A
00A3 90                  MOVX    @REG0,A

00A4 27                  CLR     A
00A5 AB                  MOV     R3,A
00A6 AC                  MOV     R4,A
```

```
00A7 EBA7      PAPER2  DJNZ    R3,PAPER2
00A9 ECA7              DJNZ    R4,PAPER2

00AB 74B4              CALL    SELINP
00AD 80                MOVX    A,@REG0

00AE 5304              ANL     A,#POSW
00B0 C68F              JZ      PAPER
00B2 ED96              DJNZ    R5,PAPERH
00B4 0483              JMP     DEB

00B6 0483      FORM    JMP     DEB

00B8 9497      LFEED   CALL    LINE

00BA 27                CLR     A
00BB AB                MOV     R3,A
00BC AC                MOV     R4,A

00BD EBBD      LFEED0  DJNZ    R3,LFEED0
00BF ECBD              DJNZ    R4,LFEED0

00C1 74B4              CALL    SELINP
00C3 80                MOVX    A,@REG0
00C4 5310              ANL     A,#LFSW
00C6 C6B8              JZ      LFEED
00C8 0483              JMP     DEB

00CA 74B4      MOVHEAD CALL    SELINP
00CC 81                MOVX    A,@R1
00CD 5302              ANL     A,#LH
00CF C6D3              JZ      MOVH0
00D1 242D              JMP     RIGHT1
00D3 81        MOVH0   MOVX    A,@R1
00D4 5301              ANL     A,#RH
00D6 C6FD              JZ      LEFT1
00D8 04FD              JMP     LEFT1
00DA 342D      MOVH1   CALL    RIGHT1
00DC 04FD              JMP     LEFT1

               ; MOVE HEAD TO THE LEFT TILL IT GETS TO THE STOP

               ; REGISTERS
               ;
               ;       RB0
               ;
               ;       R1 - ADDRESS
               ;       R3 - TIME DELAY
               ;       R4 - TIME DELAY

00DE 74BC      LEFT    CALL    SELOUT
00E0 B90B              MOV     R1,#STEPPER
00E2 23FA              MOV     A,#STEP0+STEP
00E4 91                MOVX    @R1,A

00E5 74BC      LEFT0   CALL    SELOUT
00E7 B90B              MOV     R1,#STEPPER

00E9 23F6              MOV     A,#STEP1+STEP
00EB 91                MOVX    @R1,A
00EC 947F              CALL    WAIT

00EE 23F5              MOV     A,#STEP2+STEP
```

```
00F0 91                 MOVX    @R1,A
00F1 947F               CALL    WAIT

00F3 23F9               MOV     A,#STEP3+STEP
00F5 91                 MOVX    @R1,A
00F6 947F               CALL    WAIT

00F8 23FA               MOV     A,#STEP0+STEP
00FA 91                 MOVX    @R1,A
00FB 947F               CALL    WAIT

00FD 74B4       LEFT1   CALL    SELINP
00FF 81                 MOVX    A,@R1
0100 5302               ANL     A,#LH
0102 9606               JNZ     LEFT2
0104 04DE               JMP     LEFT

0106 74BC       LEFT2   CALL    SELOUT
0108 B90B               MOV     R1,#STEPPER
010A 23FF               MOV     A,#STEP4+STEP
010C 91                 MOVX    @R1,A

010D 83                 RET

                ; MOVE HEAD TO THE RIGHT TILL IT GETS TO THE STOP

                ; REGISTERS
                ;
                ;       RB0
                ;
                ;       R1 - ADDRESS
                ;       R3 - TIME DELAY
                ;       R4 - TIME DELAY

010E 74BC       RIGHT   CALL    SELOUT
0110 B90B               MOV     R1,#STEPPER
0112 23FA               MOV     A,#STEP0+STEP
0114 91                 MOVX    @R1,A

0115 74BC       RIGHT0  CALL    SELOUT
0117 B90B               MOV     R1,#STEPPER

0119 23F9               MOV     A,#STEP3+STEP
011B 91                 MOVX    @R1,A
011C 947F               CALL    WAIT

011E 23F5               MOV     A,#STEP2+STEP
0120 91                 MOVX    @R1,A
0121 947F               CALL    WAIT
0123 23F6               MOV     A,#STEP1+STEP
0125 91                 MOVX    @R1,A
0126 947F               CALL    WAIT

0128 23FA               MOV     A,#STEP0+STEP
012A 91                 MOVX    @R1,A
012B 947F               CALL    WAIT

012D 74B4       RIGHT1  CALL    SELINP
012F 81                 MOVX    A,@R1
0130 5301               ANL     A,#RH
0132 9636               JNZ     RIGHT2
```

```
0134 240E                JMP     RIGHT

0136 74BC       RIGHT2   CALL    SELOUT
0138 B90B                MOV     R1,#STEPPER
013A 23FF                MOV     A,#STEP4+STEP
013C 91                  MOVX    @R1,A

013D 83                  RET

013E D5         FIFOIN   SEL     RB1
013F AD                  MOV     R5,A                    ;SAVE ACCUM

0140 FE                  MOV     A,R6
0141 4380                ORL     A,#BUSY
0143 AE                  MOV     R6,A
0144 39                  OUTL    P1,A

0145 15                  DIS     I

                ; USES

                ;        R2 - TIMER FLAG
                ;        R3 - # OF BITS
                ;        R4 - INPUT WORD

0146 369C       SERIN    JT0     FIFOEXT
0148 349D                CALL    CLRINT
014A D5                  SEL     RB1

014B 35                  DIS     TCNTI
014C 65                  STOP    TCNT
014D 23F9                MOV     A,#BAUD2
014F 62                  MOV     T,A
0150 25                  EN      TCNTI
0151 55                  STRT    T
0152 BA00                MOV     R2,#0
0154 FA         SERT0    MOV     A,R2
0155 C654                JZ      SERT0           ; WAIT FOR 1/2 BIT TIM
                E
0157 369C                JT0     FIFOEXT         ; NOT VALID START PULS
                E
0159 BB08                MOV     R3,#8
015B 27                  CLR     A
015C AC                  MOV     R4,A
015D BA00       SERT1    MOV     R2,#0
015F FC                  MOV     A,R4
0160 77                  RR      A
0161 AC                  MOV     R4,A
0162 FA         SERT1A   MOV     A,R2
0163 C662                JZ      SERT1A
0165 266B                JNT0    SERT3
0167 2380                MOV     A,#80H  ; MARK
0169 4C                  ORL     A,R4
016A AC                  MOV     R4,A
016B EB5D       SERT3    DJNZ    R3,SERT1
016D BA00                MOV     R2,#0
016F FA         SERT4    MOV     A,R2
0170 C66F                JZ      SERT4   ; WAIT FOR STOP
0172 269C                JNT0    FIFOEXT ; INVALID CHARACTER
0174 FC         SERT5    MOV     A,R4
0175 537F                ANL     A,#7FH
0177 AC                  MOV     R4,A
```

```
                ; SEE IF IT IS A CHARACTER THAT IS A PRINTING CHARACTE
                R

0178 D30A               XRL     A,#LF                           ; END
                OF LINE?
017A C684               JZ      FIFOIN0

                ;       MOV     A,R4
                ;       XRL     A,#TAB                          ; TAB
                CHARACTER
                ;       JZ      FIFOIN0
017C 2300               MOV     A,#LOW BTABLE
017E 6C                 ADD     A,R4

017F E3                 MOVP3   A,@A

0180 9684               JNZ     FIFOIN0
0182 249C               JMP     FIFOEXT

                ; STORE CHARACTER IN BUFFER

0184 B925       FIFOIN0 MOV     R1,#MEMIN0
0186 F1                 MOV     A,@R1
0187 A8                 MOV     REG0,A                          ; LOW
                BYTE

0188 19                 INC     R1
0189 F1                 MOV     A,@R1
018A 9488               CALL    SELMEM2

018C FC                 MOV     A,R4
018D 90                 MOVX    @REG0,A                         ; WRIT
                E IT

018E C9                 DEC     R1
018F 11                 INC     @R1                             ; INCR
                EMENT LSB
0190 F1                 MOV     A,@R1
0191 969C               JNZ     FIFOEXT
0193 19                 INC     R1
0194 11                 INC     @R1                             ; INCR
                EMENT MSB
0195 F1                 MOV     A,@R1                           ; SEE
                IF AT TOP OF MEMORY
0196 D301               XRL     A,#MEMTOP
0198 969C               JNZ     FIFOEXT

019A B100               MOV     @R1,#0                          ; SET
                AT 0

019C FD         FIFOEXT MOV     A,R5                    ; RESTORE ACC.
019D 93         CLRINT  RETR
019E            MEM30   EQU     ¤

0300                    ORG     300H

0300            MEM31   EQU     ¤

0300                    IF HIGH MEM31 - HIGH (MEM30-1) EQ 0

0300            ERROR   EQU     ¤

0300                    ENDIF
```

```
0300 00        BTABLE  DB      0               ; 00
0301 00                DB      0               ; 01
0302 00                DB      0               ; 02
0303 00                DB      0               ; 03
0304 00                DB      0               ; 04
0305 00                DB      0               ; 05
0306 00                DB      0               ; 06
0307 00                DB      0               ; 07
0308 00                DB      0               ; 08
0309 C1                DB      SPEC+1          ; 09
030A 00                DB      0               ; 0A LINE FEED
030B 00                DB      0               ; 0B
030C C2                DB      SPEC+2          ; 0C FORM FEED
030D 00                DB      0               ; 0D CARRIGE RETURN
030E 00                DB      0               ; 0E
030F 00                DB      0               ; 0F
0310 00                DB      0               ; 10
0311 00                DB      0               ; 11
0312 00                DB      0               ; 12
0313 00                DB      0               ; 13
0314 00                DB      0               ; 14
0315 00                DB      0               ; 15
0316 00                DB      0               ; 16
0317 00                DB      0               ; 17
0318 00                DB      0               ; 18
0319 00                DB      0               ; 19
031A 00                DB      0               ; 1A
031B C3                DB      SPEC+3          ; 1B
031C 00                DB      0               ; 1C
031D 00                DB      0               ; 1D
031E 00                DB      0               ; 1E
031F 00                DB      0               ; 1F
0320 C0                DB      SPEC+0          ; 20 SPACE
0321 1C                DB      1CH             ; 21 !
0322 38                DB      38H             ; 22 "
0323 00                DB      0               ; 23 #
0324 00                DB      0               ; 24 ¤
0325 00                DB      0               ; 25 %
0326 00                DB      0               ; 26 &
0327 10                DB      10H             ; 27 '
0328 3C                DB      3CH             ; 28 (
0329 3C                DB      3CH             ; 29 )
032A 00                DB      0               ; 2A *
032B 00                DB      0               ; 2B +
032C 04                DB      4               ; 2C ,
032D 30                DB      30H             ; 2D -
032E 2C                DB      2CH             ; 2E .
032F 00                DB      0               ; 2F /

               ; NUMBERS

0330 8E                DB      NUMB+0EH        ; 30 0
0331 81                DB      NUMB+1          ; 31 1
0332 85                DB      NUMB+5          ; 32 2
0333 83                DB      NUMB+3          ; 33 3
0334 8B                DB      NUMB+0BH        ; 34 4
0335 89                DB      NUMB+9          ; 35 5
0336 87                DB      NUMB+7          ; 36 5
0337 8F                DB      NUMB+0FH        ; 37 7
0338 8D                DB      NUMB+0DH        ; 38 8
0339 86                DB      NUMB+6          ; 39 9

               ;
```

```
033A 0C          DB      0CH          ; 3A :
033B 14          DB      14H          ; 3B ;
033C 00          DB      0            ; 3C <
033D 00          DB      0            ; 3D =
033E 00          DB      0            ; 3E >
033F 34          DB      34H          ; 3F ?
0340 00          DB      0            ; 40 @

                 ; CAPITAL LETTERS
0341 41          DB      CAPS+1       ; 41   A
0342 45          DB      CAPS+5       ; 42   B
0343 43          DB      CAPS+3       ; 43   C
0344 4B          DB      CAPS+0BH     ; 44   D
0345 49          DB      CAPS+9       ; 45   E
0346 47          DB      CAPS+7       ; 46   F
0347 4F          DB      CAPS+0FH     ; 47   G
0348 4D          DB      CAPS+0DH     ; 48   H
0349 46          DB      CAPS+6       ; 49   I
034A 4E          DB      CAPS+0EH     ; 4A   J
034B 51          DB      CAPS+11H     ; 4B   K
034C 55          DB      CAPS+15H     ; 4C   L
034D 53          DB      CAPS+13H     ; 4D   M
034E 5B          DB      CAPS+1BH     ; 4E   N
034F 59          DB      CAPS+19H     ; 4F   O
0350 57          DB      CAPS+17H     ; 50   P
0351 5F          DB      CAPS+1FH     ; 51   Q
0352 5D          DB      CAPS+1DH     ; 52   R
0353 56          DB      CAPS+16H     ; 53   S
0354 5E          DB      CAPS+1EH     ; 54   T
0355 71          DB      CAPS+31H     ; 55   U
0356 75          DB      CAPS+35H     ; 56   V
0357 6E          DB      CAPS+2EH     ; 57   W
0358 73          DB      CAPS+33H     ; 58   X
0359 7B          DB      CAPS+3BH     ; 59   Y
035A 79          DB      CAPS+39H     ; 5A   Z

                 ;

035B 00          DB      0            ; 5B [
035C 00          DB      0            ; 5C \
035D 00          DB      0            ; 5D ]
035E 00          DB      0            ; 5E ^
035F 00          DB      0            ; 5F _
0360 00          DB      0            ; 60 `

                 ; LOWER CASE

0361 01          DB      1            ; 61   A
0362 05          DB      5            ; 62   B
0363 03          DB      3            ; 63   C
0364 0B          DB      0BH          ; 64   D
0365 09          DB      9            ; 65   E
0366 07          DB      7            ; 66   F
0367 0F          DB      0FH          ; 67   G
0368 0D          DB      0DH          ; 68   H
0369 06          DB      6            ; 69   I
036A 0E          DB      0EH          ; 6A   J
036B 11          DB      11H          ; 6B   K
036C 15          DB      15H          ; 6C   L
036D 13          DB      13H          ; 6D   M
036E 1B          DB      1BH          ; 6E   N
036F 19          DB      19H          ; 6F   O
0370 17          DB      17H          ; 70   P
```

```
0371 1F                DB      1FH             ; 71    Q
0372 1D                DB      1DH             ; 72    R
0373 16                DB      16H             ; 73    S
0374 1E                DB      1EH             ; 74    T
0375 31                DB      31H             ; 75    U
0376 35                DB      35H             ; 76    V
0377 2E                DB      2EH             ; 77    W
0378 33                DB      33H             ; 78    X
0379 3B                DB      3BH             ; 79    Y
037A 39                DB      39H             ; 7A    Z

                ;

037B 00                DB      0               ; 7B {
037C 00                DB      0               ; 7C |
037D 00                DB      0               ; 7D }
037E 00                DB      0               ; 7E ~
037F 00                DB      0               ; 7F DEL

0380 05         PTABLE DB      PUNCH0
0381 06                DB      PUNCH1
0382 03                DB      PUNCH2
0383 02                DB      PUNCH3
0384 01                DB      PUNCH4
0385 00                DB      PUNCH5
0386 09                DB      PUNCH6
0387 08                DB      PUNCH7
0388 07                DB      PUNCH8
0389 04                DB      PUNCH9

038A 01         TESTPR DB      1               ; 61    A
038B 05                DB      5               ; 62    B
038C 03                DB      3               ; 63    C
038D 0B                DB      0BH             ; 64    D
038E 09                DB      9               ; 65    E
038F 07                DB      7               ; 66    F
0390 0F                DB      0FH             ; 67    G
0391 0D                DB      0DH             ; 68    H
0392 06                DB      6               ; 69    I
0393 0E                DB      0EH             ; 6A    J
0394 11                DB      11H             ; 6B    K
0395 15                DB      15H             ; 6C    L
0396 13                DB      13H             ; 6D    M
0397 1B                DB      1BH             ; 6E    N
0398 19                DB      19H             ; 6F    O
0399 17                DB      17H             ; 70    P
039A 1F                DB      1FH             ; 71    Q
039B 1D                DB      1DH             ; 72    R
039C 16                DB      16H             ; 73    S
039D 1E                DB      1EH             ; 74    T
039E 31                DB      31H             ; 75    U
039F 35                DB      35H             ; 76    V
03A0 2E                DB      2EH             ; 77    W
03A1 33                DB      33H             ; 78    X
03A2 3B                DB      3BH             ; 79    Y
03A3 39                DB      39H             ; 7A    Z
03A4 00                DB      0
03A5 3A                DB      3AH
03A6 01                DB      1               ; 31 1
03A7 05                DB      5               ; 32 2
03A8 03                DB      3               ; 33 3
03A9 0B                DB      0BH             ; 34 4
03AA 09                DB      9               ; 35 5
```

```
03AB 07                 DB      7               ; 36 5
03AC 0F                 DB      0FH             ; 37 7
03AD 0D                 DB      0DH             ; 38 8
03AE 06                 DB      6               ; 39 9
03AF 0E                 DB      0EH             ; 30 0
03B0 00                 DB      0
03B1 00                 DB      0
03B2 00                 DB      0
03B3 00                 DB      0

                ;       SELECTS INPUT PORT
03B4 D5         SELINP  SEL     RB1
03B5 FE                 MOV     A,R6
03B6 53FC               ANL     A,#0FCH
03B8 437E               ORL     A,#INPUT
03BA 64D1               JMP     SEL

                ;       SELECTS OUTPUT PORT

03BC D5         SELOUT  SEL     RB1
03BD FE                 MOV     A,R6
03BE 53FC               ANL     A,#0FCH
03C0 437D               ORL     A,#OUTPUT
03C2 64D1               JMP     SEL

                ;       SELECTS OUTPUT PORT 1

03C4 D5         SELOUT1 SEL     RB1
03C5 FE                 MOV     A,R6
03C6 53FC               ANL     A,#0FCH
03C8 437E               ORL     A,#OUTPUT0
03CA 64D1               JMP     SEL

                ;       SELECTS MEMORY
                ;       R2 IS ADDRESS MSB

03CC 3A         SELMEM1 OUTL    P2,A
03CD D5         SELMEM  SEL     RB1
03CE FE                 MOV     A,R6
03CF 53FC               ANL     A,#0FCH
03D1 AE         SEL     MOV     R6,A
03D2 C5                 SEL     RB0
03D3 39                 OUTL    P1,A
03D4 83                 RET

03D5            MEM40   EQU     ¤

0400                    ORG     400H

0400            MEM41   EQU     ¤

0400                    IF HIGH MEM41 - HIGH (MEM40-1) EQ 0

0400            ERROR   EQU     ¤
0400                    ENDIF


                ; PRINT A LINE
                ; USES
                ;       R0 - BUFFER ADDRESS
                ;       R1 - MISC ADDRESS
                ;       R3 - TEMP
                ;       R4 - TEMP
```

```
                ;       R6 - ROW
                ;       LATCH - NUMBER OF THE LATCH
                ;       MASK - MASK WHAT BITS FROM BTABLE
                ;       SAVE - RESULTS OF MASK AND VALUE OF BTABLE
                ;       LCHP - LATCH POSITION 0 - 3
                ;       VALUE - VALUE TO OUTPUT TO THE LATCH

0400 BE00       PRINT   MOV     R6,#0                   ; FIRST ROW
0402 B858       PRINT0  MOV     REG0,#BUFFER            ; BEGINING OF
                BUFFER
0404 B920               MOV     R1,#LATCH               ; FIRST LATCH
0406 27                 CLR     A
0407 A1                 MOV     @R1,A
0408 B92E               MOV     R1,#OUTOR
040A A1                 MOV     @R1,A
040B B921       PRINT1  MOV     R1,#LCHP                ; FIRST LATCH
                POSITION
040D 27                 CLR     A
040E A1                 MOV     @R1,A
040F B922               MOV     R1,#VALUE               ; CLEAR VALUE
0411 A1                 MOV     @R1,A
0412 8456       PRINT2  JMP     CONVT                   ; GET NEW VALU
                E
0414 18         PRINT2A INC     REG0                    ; INCREMENT BU
                FFER POSITION

0415 B921               MOV     R1,#LCHP                ; INCREMENT LA
                TCH POSITION
0417 11                 INC     @R1
0418 F1                 MOV     A,@R1
0419 D304               XRL     A,#4                    ; IS THE LATCH
                 FULL ?
041B 9612               JNZ     PRINT2
041D 74BC               CALL    SELOUT

041F B920               MOV     R1,#LATCH               ; GET LATCH NU
                MBER
0421 F1                 MOV     A,@R1
0422 0380               ADD     A,#LOW PTABLE           ; ADD PTABLE O
                FFSET
0424 E3                 MOVP3   A,@A                    ; GET VALUE
0425 AB                 MOV     R3,A                    ; PUT IN FOR A
                DDRESS
0426 B922               MOV     R1,#VALUE               ; GET VALUE
0428 F1                 MOV     A,@R1
0429 AC                 MOV     R4,A                    ; SAVE VALUE
042A FB                 MOV     A,R3                    ; GET LATCH VA
                LUE
042B A9                 MOV     R1,A                    ; ADDRESS
042C FC                 MOV     A,R4                    ; VALUE
042D 91                 MOVX    @R1,A                   ; OUTPUT VALUE
                 TO LATCH

042E B92E               MOV     R1,#OUTOR
0430 41                 ORL     A,@R1
0431 A1                 MOV     @R1,A                   ; SET OUT OR

0432 B920               MOV     R1,#LATCH               ; INCREMENT LA
                TCH
0434 11                 INC     @R1
0435 F1                 MOV     A,@R1                   ; SEE IF LATCH
                ES ARE DONE
0436 D30A               XRL     A,#10
```

```
0438 C63C                JZ      PRINT3

043A 840B                JMP     PRINT1                  ; GET ANOTHER

043C B92E       PRINT3   MOV     R1,#OUTOR
043E F1                  MOV     A,@R1
043F C643                JZ      PRINT3A                 ; NO PUNCHES O
                N

0441 14CA                CALL    MOVHEAD                 ; MOVE HEAD TO
                 OPPOSITE SIDE
0443 74BC       PRINT3A CALL     SELOUT                  ; TURN OFF ALL
                 PUNCHES
0445 B90A                MOV     R1,#RESET
0447 91                  MOVX    @R1,A

0448 9497                CALL    LINE                    ; NEXT LINE

044A 1E                  INC     R6
044B FE                  MOV     A,R6
044C D303                XRL     A,#3                    ; DONE ALL
044E 9602                JNZ     PRINT0                  ; NOPE - DO AN
                OTHER LINE

0450 9497                CALL    LINE                    ; YES DO THE E
                XTRA LINE
0452 948C                CALL    LINEN
0454 A403                JMP     CLRBUF                  ; CLEAR BUFFER
                 FOR NEXT LINE

                ; TAKES THE VALUE FROM THE BUFFER
                ; ADDS THE BTABLE OFFSET TO IT
                ; USES MASKS THE CORRECT BITS FOR THE ROW
                ; OFFSETS THIS TO THE CORRECT BIT POSITION FOR THE LAT
                CH

                ;
                ;       R0 - BUFFER ADDRESS
                ;       R1 - MISC ADDRESS
                ;       R3 - TEMP
                ;       R6 - ROW
                ;       MASK - MASK WHAT BITS FROM BTABLE
                ;       SAVE - RESULTS OF MASK AND VALUE OF BTABLE
                ;       LCHP - LATCH POSITION 0 - 3
                ;       VALUE - VALUE TO OUTPUT TO THE LATCH

                ; GET THE VALUE FROM THE BUFFER

0456 F0         CONVT    MOV     A,@REG0

0457 B924                MOV     R1,#SAVE                ; SAVE THE VAL
                UE
0459 A1                  MOV     @R1,A
045A FE                  MOV     A,R6                    ; GET TO BITS
                01
045B E7                  RL      A                       ; MULTIPLY BY
                TWO
045C AB                  MOV     R3,A                    ; NUMBER OF TI
                MES TO ROTATE
045D C664                JZ      CONVT0B                 ; DO NOT HAVE
                TO ROTATE FOR ROW 1

045F F1         CONVT0A MOV      A,@R1                   ; GET IT TO PR
```

```
                OPER BITS
0460 77                 RR      A
0461 A1                 MOV     @R1,A
0462 EB5F               DJNZ    R3,CONVT0A

0464 F1         CONVT0B MOV     A,@R1                   ; MASK OFF THE
                 REST OF THE BITS
0465 5303               ANL     A,#3
0467 A1                 MOV     @R1,A                   ; SAVE

0468 B921               MOV     R1,#LCHP                ; GET THE LATC
                H POSITION
046A F1                 MOV     A,@R1
046B AB                 MOV     R3,A
046C C676               JZ      CONVT1

046E B924       ROTATE  MOV     R1,#SAVE                ; OFFSET IT TO
                 THE RIGHT LATCH POS.
0470 F1                 MOV     A,@R1
0471 E7                 RL      A
0472 E7                 RL      A
0473 A1                 MOV     @R1,A
0474 EB6E               DJNZ    R3,ROTATE

0476 B924       CONVT1  MOV     R1,#SAVE                ; OR THE PRESE
                NT VALUE TO NEW VALUE
0478 F1                 MOV     A,@R1
0479 B922               MOV     R1,#VALUE
047B 41                 ORL     A,@R1
047C A1                 MOV     @R1,A
047D 8414               JMP     PRINT2A

047F BB01       WAIT    MOV     R3,#1   ; REM * * 5H
                  ; DELAY FOR STEPPERS
0481 BC01               MOV     R4,#1   ; REM * * 0
0483 EC83       WAIT0   DJNZ    R4,WAIT0
0485 EB83               DJNZ    R3,WAIT0
0487 83                 RET

0488 3A         SELMEM2 OUTL    P2,A
0489 99FC       SELMEM3 ANL     P1,#BUSY+MEMSEL
048B 83                 RET

048C B931       LINEN   MOV     R1,#LINENO
048E 11                 INC     @R1
048F F1                 MOV     A,@R1
0490 D320               XRL     A,#FORML
0492 9696               JNZ     LINEN0
0494 B100               MOV     @R1,#0
0496 83         LINEN0  RET


                ; REGISTERS
                ;
                ;       RB0
                ;
                ;       R1 - ADDRESS
                ;       R3 - TIME DELAY
                ;       R4 - TIME DELAY
                ;       R7 - NUMBER OF STEPS

0497 BF01       LINE    MOV     R7,#1   ; REM * * 2
```

```
0499 74BC      LINE0   CALL    SELOUT
049B B90B              MOV     R1,#STEPPER
049D 23AF              MOV     A,#LSTEP0+LSTEP
049F 91                MOVX    @R1,A

04A0 74BC      LINE1   CALL    SELOUT
04A2 B90B              MOV     R1,#STEPPER

04A4 236F              MOV     A,#LSTEP1+LSTEP
04A6 91                MOVX    @R1,A
04A7 947F              CALL    WAIT

04A9 235F              MOV     A,#LSTEP2+LSTEP
04AB 91                MOVX    @R1,A
04AC 947F              CALL    WAIT

04AE 239F              MOV     A,#LSTEP3+LSTEP
04B0 91                MOVX    @R1,A
04B1 947F              CALL    WAIT

04B3 23AF              MOV     A,#LSTEP0+LSTEP
04B5 91                MOVX    @R1,A
04B6 947F              CALL    WAIT

04B8 EFA0              DJNZ    R7,LINE1

04BA B90B              MOV     R1,#STEPPER
04BC 23FF              MOV     A,#LSTEP4+LSTEP
04BE 91                MOVX    @R1,A
04BF 83                RET

04C0 BB28      TESTLP  MOV     R3,#40
04C2 B858      TEST1   MOV     REG0,#BUFFER
04C4 B98A              MOV     R1,#LOW TESTPR          ; CHARACTER TO
                PROCESS
04C6 F9        TEST2   MOV     A,R1
04C7 E3                MOVP3   A,@A
04C8 A0                MOV     @REG0,A
04C9 19                INC     R1
04CA 18                INC     REG0
04CB EBC6              DJNZ    R3,TEST2                ; DO THIS 40 T
                IMES

04CD 9400              CALL    PRINT
04CF 84C0              JMP     TESTLP                  ; PRINT A LINE

04D1 9400      FORMF   CALL    PRINT
04D3 B931      FORMF0  MOV     R1,#LINENO
04D5 F1                MOV     A,@R1
04D6 D320              XRL     A,#FORML
04D8 C6E5              JZ      FFEXT
04DA 9497              CALL    LINE
04DC 9497              CALL    LINE
04DE 9497              CALL    LINE
04E0 B931              MOV     R1,#LINENO
04E2 11                INC     @R1
04E3 84D3              JMP     FORMF0
04E5 83        FFEXT   RET

04E6 BB00      ESC1    MOV     R3,#0

04E8 FC                MOV     A,R4
04E9 D355              XRL     A,#55H
```

```
04EB C6F9                JZ      CMODE
04ED 1B                  INC     R3

04EE FC                  MOV     A,R4
04EF D343                XRL     A,#43H
04F1 C6F9                JZ      CMODE
04F3 1B                  INC     R3

04F4 FC                  MOV     A,R4
04F5 D347                XRL     A,#47H
04F7 96FD                JNZ     CMODE0

04F9 B92F        CMODE   MOV     R1,#MODE
04FB FB                  MOV     A,R3
04FC A1                  MOV     @R1,A                    ; SET NEW MODE

04FD B932        CMODE0  MOV     R1,#ESC
04FF B100                MOV     @R1,#0
0501 C40E                JMP     BUFFINX

0503 BC28        CLRBUF  MOV     R4,#40
0505 B858                MOV     REG0,#BUFFER
0507 27          CLRBUF0 CLR     A
0508 A0                  MOV     @REG0,A
0509 18                  INC     REG0
050A EC07                DJNZ    R4,CLRBUF0

050C B929                MOV     R1,#BUFPNT
050E B158                MOV     @R1,#BUFFER
0510 83                  RET

0511 A0          BUFF    MOV     @REG0,A

0512 B933                MOV     R1,#R4SAVE
0514 FC                  MOV     A,R4
0515 A1                  MOV     @R1,A
0516 B829                MOV     REG0,#BUFPNT
0518 10                  INC     @REG0
0519 F0                  MOV     A,@REG0
051A D380                XRL     A,#BUFTOP
051C 9620                JNZ     BUFEXT
051E 9400                CALL    PRINT
0520 B933        BUFEXT  MOV     R1,#R4SAVE
0522 F1                  MOV     A,@R1
0523 AC                  MOV     R4,A
0524 B829                MOV     REG0,#BUFPNT
0526 F0                  MOV     A,@REG0
0527 A8                  MOV     REG0,A
0528 83                  RET

0529             MEM60   EQU     ¤

0600                     ORG     600H

0600             MEM61   EQU     ¤

0600                     IF HIGH MEM61 - HIGH (MEM60-1) EQ 0

0600             ERROR   EQU     ¤

0600                     ENDIF

                 ; ROUTINE TO GET CHARACTERS INTO THE BUFFER
```

```
                ; CHECK TO SEE IF THERE IS A CHARACTER IN THE BUFFER

0600 B925       BUFFIN  MOV     R1,#MEMIN0
0602 B827               MOV     REG0,#MEMOUT0
0604 F0                 MOV     A,@REG0
0605 18                 INC     REG0
0606 D1                 XRL     A,@R1                   ; DO LSB
0607 19                 INC     R1
0608 9619               JNZ     BUFFIN0

060A F0                 MOV     A,@REG0
060B D1                 XRL     A,@R1

060C 9619               JNZ     BUFFIN0                 ; GET CHARACTE
                R IN BUFFER

060E 05         BUFFINX EN      I
060F D5                 SEL     RB1
0610 FE                 MOV     A,R6
0611 537F               ANL     A,#NOT BUSY
0613 AE                 MOV     R6,A
0614 C5                 SEL     RB0
0615 39                 OUTL    P1,A                    ; BUFFER STILL
                 CAN TAKE CHARACTERS
0616 97                 CLR     C
0617 0456               JMP     LOOPXX

                ; GET CHARACTER INTO BUFFER

0619 F0         BUFFIN0 MOV     A,@REG0
061A 74CC               CALL    SELMEM1

061C C8                 DEC     REG0
061D F0                 MOV     A,@REG0
061E A9                 MOV     R1,A                    ; LOWER BYTE

061F 10                 INC     @REG0                   ; INCREMENT LO
                WER
0620 F0                 MOV     A,@REG0
0621 962C               JNZ     BUFFIN1
0623 18                 INC     REG0                    ; LOWERER IS Z
                ERO SO INCREMENT UPPER
0624 10                 INC     @REG0
0625 F0                 MOV     A,@REG0
0626 D301               XRL     A,#MEMTOP               ; IS UPPER MOR
                E THAT TOP
0628 962C               JNZ     BUFFIN1
062A B000               MOV     @REG0,#0

062C 81         BUFFIN1 MOVX    A,@R1                   ; GET BYTE

062D D30A               XRL     A,#LF                   ; END OF LINE?
                ???
062F C6DC               JZ      BUFFIN5

0631 B829               MOV     REG0,#BUFPNT
0633 F0                 MOV     A,@REG0
0634 A8                 MOV     REG0,A                  ; PLACE TO PUT
                 IT IN THE BUFFER
0635 81                 MOVX    A,@R1
0636 0300               ADD     A,#LOW BTABLE           ; SEE IF PRINT
                ING CHARACTER
0638 E3                 MOVP3   A,@A
```

```
0639 C6DA                JZ      BUFFIN4                 ; NOT A PRINTI
                NG CHARACTER
063B AC                  MOV     R4,A
063C 53C0                ANL     A,#0C0H
063E AB                  MOV     R3,A
063F C6C7                JZ      BUFFIN2

                ; CHECK TO SEE IF ANY SPECIAL CHARACTERS

0641 FC                  MOV     A,R4
0642 D3C0                XRL     A,#SPEC+0
0644 C6C7                JZ      BUFFIN2                 ; ONLY A SPACE

0646 FC                  MOV     A,R4
0647 D3C1                XRL     A,#SPEC+1               ; TAB
0649 9658                JNZ     SPEC0

                ; TAB TO EVEN 8 MARK

064B 27         TAB      CLR     A
064C B411                CALL    BUFF
064E B829                MOV     REG0,#BUFPNT
0650 F0                  MOV     A,@REG0
0651 A8                  MOV     REG0,A
0652 5307                ANL     A,#7
0654 964B                JNZ     TAB
0656 C40E                JMP     BUFFINX

0658 FC         SPEC0    MOV     A,R4
0659 D3C2                XRL     A,#SPEC+2               ; FORM FEED
065B 9661                JNZ     SPEC1

                ; FORM FEED

065D 94D1                CALL    FORMF
065F C40E                JMP     BUFFINX
0661 FC         SPEC1    MOV     A,R4
0662 D3C3                XRL     A,#SPEC+3               ; ESCAPE
0664 966C                JNZ     SPEC2

0666 B932                MOV     R1,#ESC
0668 B101                MOV     @R1,#1                  ; ESC RECEIVED
066A C40E                JMP     BUFFINX

066C C476       SPEC2    JMP     SPEC3   ; MOV   A,R4
066E 53C0                ANL     A,#0C0H
0670 D3C0                XRL     A,#0C0H
0672 9676                JNZ     SPEC3
0674 C40E       LET1     JMP     BUFFINX

0676 B92F       SPEC3    MOV     R1,#MODE
0678 F1                  MOV     A,@R1
0679 C47B                JMP     LET ;   JNZ     MODE0

                ; LETTERS MODE

067B FB         LET      MOV     A,R3
067C D340                XRL     A,#CAPS
067E 9686                JNZ     LET0

0680 2320                MOV     A,#CAPSIGN
0682 B411       LET0A    CALL    BUFF
0684 C4C7                JMP     BUFFIN2
```

```
0686 FB        LET0     MOV     A,R3
0687 D380               XRL     A,#NUMB
0689 9674               JNZ     LET1

068B 233A               MOV     A,#NUMSIGN
068D C482               JMP     LET0A

               ;

068F F1        MODE0    MOV     A,@R1
0690 D301               XRL     A,#1
0692 969B               JNZ     MODE1

               ; COMPUTER MODE
0694 FB        COM      MOV     A,R3
0695 D340               XRL     A,#CAPS
0697 C6C7               JZ      BUFFIN2
0699 C486               JMP     LET0

069B F1        MODE1    MOV     A,@R1
069C D303               XRL     A,#3
069E 967B               JNZ     LET

               ; FINACIAL MODE

06A0 FB                 MOV     A,R3
06A1 D380               XRL     A,#NUMB
06A3 96B2               JNZ     FIN0
06A5 B930               MOV     R1,#PRMODE
06A7 F1                 MOV     A,@R1
06A8 96AC               JNZ     FINA
06AA B101               MOV     @R1,#1

06AC 233A      FINA     MOV     A,#NUMSIGN
06AE B411               CALL    BUFF
06B0 C4C7               JMP     BUFFIN2

06B2 B930      FIN0     MOV     R1,#PRMODE
06B4 F1                 MOV     A,@R1
06B5 C694               JZ      COM

06B7 FC                 MOV     A,R4
06B8 D32C               XRL     A,#2CH          ; PERIOD
06BA C694               JZ      COM

06BC FC                 MOV     A,R4
06BD D304               XRL     A,#4
06BF C694               JZ      COM

06C1 B100               MOV     @R1,#0
06C3 C494               JMP     COM

06C5 C40E      MODE2    JMP     BUFFINX

06C7 B932      BUFFIN2  MOV     R1,#ESC
06C9 F1                 MOV     A,@R1
06CA C4CE               JMP     BUFFIN3         ;JZ     BUFFIN3
06CC 84E6               JMP     ESC1

06CE FC        BUFFIN3  MOV     A,R4
06CF 533F               ANL     A,#3FH
06D1 A0                 MOV     @REG0,A
```

```
06D2 B829                MOV     REG0,#BUFPNT
06D4 10                  INC     @REG0
06D5 F0                  MOV     A,@REG0
06D6 D380                XRL     A,#BUFTOP
06D8 C6DC                JZ      BUFFIN5                    ; PRINT BUFFER
                  IS FULL SO PRINT IT

06DA C40E        BUFFIN4 JMP     BUFFINX                    ;BUFFER STILL
                 CAN TAKE CHARACTERS

06DC 05          BUFFIN5 EN      I        ; BUFFER CAN TAKE MORE CHARACT
                 ERS
06DD D5                  SEL     RB1
06DE FE                  MOV     A,R6
06DF 537F                ANL     A,#NOT BUSY
06E1 AE                  MOV     R6,A
06E2 C5                  SEL     RB0
06E3 39                  OUTL    P1,A                       ; BUFFER STILL
                  CAN TAKE CHARACTERS
06E4 97                  CLR     C
06E5 A7                  CPL     C                          ; TELL PROGRAM
                  THAT IT IS TIME TO PRINT
06E6 0456                JMP     LOOPXX
```

```
0000                     END
ACCEXT    002D           FIFOEXT   019C          MEM30     019E
ACCTIM    002C           FIFOIN    013E          MEM31     0300
BAUD      FFF2           FIFOIN0   0184          MEM40     03D5
BAUD2     FFF9           FIN0      06B2          MEM41     0400
BS        0008           FINA      06AC          MEM60     0529
BTABLE    0300           FORM      00B6          MEM61     0600
BUFEXT    0520           FORMF     04D1          MEMIN0    0025
BUFF      0511           FORMF0    04D3          MEMIN1    0026
BUFFER    0058           FORML     0020          MEMOUT0   0027
BUFFIN    0600           INPUT     007E          MEMOUT1   0028
BUFFIN0   0619           INPUT0    007F          MEMSEL    007C
BUFFIN1   062C           LATCH     0020          MEMTOP    0001
BUFFIN2   06C7           LCHP      0021          MEMTS0    0046
BUFFIN3   06CE           LEFT      00DE          MEMTS1    0047
BUFFIN4   06DA           LEFT0     00E5          MEMTS2    0048
BUFFIN5   06DC           LEFT1     00FD          MEMTS3    0049
BUFFINX   060E           LEFT2     0106          MEMTS4    004A
BUFPNT    0029           LET       067B          MODE      002F
BUFTOP    0080           LET0      0686          MODE0     068F
BUSY      0080           LET0A     0682          MODE1     069B
BUZZER    0008           LET1      0674          MODE2     06C5
CAPS      0040           LF        000A          MOVH0     00D3
CAPSIGN   0020           LFEED     00B8          MOVH1     00DA
CDATAIN   007D           LFEED0    00BD          MOVHEAD   00CA
CDATAO    007F           LFSW      0010          NBUSY     0000
CLRBUF    0503           LH        0002          NORM      0000
CLRBUF0   0507           LINE      0497          NUMB      0080
CLRINT    019D           LINE0     0499          NUMSIGN   003A
CMODE     04F9           LINE1     04A0          OFFLINE   0080
CMODE0    04FD           LINEN     048C          OFFLSW    0020
COM       0694           LINEN0    0496          OUTOR     002E
CONVT     0456           LINENO    0031          OUTPUT    007D
CONVT0A   045F           LOOP      0054          OUTPUT0   007E
CONVT0B   0464           LOOP0     005C          PAPER     008F
CONVT1    0476           LOOPON    0076          PAPER1    009E
CR        000D           LOOPXX    0056          PAPER2    00A7
```

| | | | | | |
|---|---|---|---|---|---|
| DEB | 0083 | LSTEP | 000F | PAPERH | 0096 |
| DEB0 | 0085 | LSTEP0 | 00A0 | POSW | 0004 |
| ERROR | 0000 | LSTEP1 | 0060 | PRINT | 0400 |
| ESC | 0032 | LSTEP2 | 0050 | PRINT0 | 0402 |
| ESC1 | 04E6 | LSTEP3 | 0090 | PRINT1 | 040B |
| FFEXT | 04E5 | LSTEP4 | 00F0 | PRINT2 | 0412 |
| FFSW | 0008 | MASK | 0023 | PRINT2A | 0414 |
| PRINT3 | 043C | RIGHT1 | 012D | SPEC2 | 066C |
| PRINT3A | 0443 | RIGHT2 | 0136 | SPEC3 | 0676 |
| PRMODE | 0030 | ROTATE | 046E | START | 0012 |
| PSTATUS | 002A | SAVE | 0024 | START0 | 0037 |
| PSWST | 002B | SEL | 03D1 | STEP | 00F0 |
| PTABLE | 0380 | SELINP | 03B4 | STEP0 | 000A |
| PUNCH0 | 0005 | SELMEM | 03CD | STEP1 | 0006 |
| PUNCH1 | 0006 | SELMEM1 | 03CC | STEP2 | 0005 |
| PUNCH2 | 0003 | SELMEM2 | 0488 | STEP3 | 0009 |
| PUNCH3 | 0002 | SELMEM3 | 0489 | STEP4 | 000F |
| PUNCH4 | 0001 | SELOUT | 03BC | STEPPER | 000B |
| PUNCH5 | 0000 | SELOUT1 | 03C4 | SW | 007C |
| PUNCH6 | 0009 | SERIN | 0146 | TAB | 064B |
| PUNCH7 | 0008 | SERT0 | 0154 | TEST1 | 04C2 |
| PUNCH8 | 0007 | SERT1 | 015D | TEST2 | 04C6 |
| PUNCH9 | 0004 | SERT1A | 0162 | TESTLP | 04C0 |
| R4SAVE | 0033 | SERT3 | 016B | TESTPR | 038A |
| REG0 | R0 | SERT4 | 016F | TESTSW | 0004 |
| RESET | 000A | SERT5 | 0174 | TIMER | 0007 |
| RH | 0001 | SPEC | 00C0 | VALUE | 0022 |
| RIGHT | 010E | SPEC0 | 0658 | WAIT | 047F |
| RIGHT0 | 0115 | SPEC1 | 0661 | WAIT0 | 0483 |

A preferred embodiment of the present invention has been described herein. It is to be understood, however, that changes and modifications can be made without departing from the true scope and spirit of the present invention. For example, an alternative printer could include a wheel having a series of pins and a pin driver within it. The paper would then be laid on a base, and the base would include a series of depressions spaced to correspond to the pins in the wheel. A controller would activate the driver to raise selected pins. The wheel would then roll over the paper, driving any extended pins into the depressions in the base. The raised pins in the wheel would thus cause tactile impressions to be made on the paper, which is between the wheel and base.

Thus, a large variety of variations from the present invention are possible, without departing from the true scope and spirit of the invention. This true scope and spirit are defined by the following claims and their equivalents to be interpreted in light of the foregoing specification.

What is claimed is:

1. An apparatus for making tactile impressions on paper comprising, in combination:

a housing means for advancing paper along a line of motion in said housing, a plurality of pins in said housing;

means in said housing for guiding said pins toward and away from said paper;

a driver for selectively extending said pins toward said paper; and platen means rotatably translated across said paper for pressing said paper and said pins in close contact, said platen means comprising a first platen rotatable about an axis and moveable transversely with respect to the line of motion across the paper, whereby said selectively extended pins leave a tactile impression on said paper.

2. An apparatus as claimed in claim 1, further comprising paper receiving means for receiving said paper.

3. An apparatus as claimed in claim 2, wherein said paper receiving means further comprises bracket means for holding said platen means in contact with said paper.

4. An apparatus as claimed in claim 3, wherein said platen means comprises a reversible motor interconnected to said first platen for rolling said first platen over said pins.

5. An apparatus as claimed in claim 4, wherein said paper receiving means includes a cylindrical platen and a paper advance motor interconnected thereto for rotating said cylindrical platen.

6. An apparatus for making tactile impressions on paper comprising: in combination:

a housing;

means for advancing paper along a line of motion in said housing, paper receiving means in said housing for receiving said paper, a plurality of pins in said housing;

means for guiding said pins toward and away from said paper;

a plurality of drivers in said housing operatively connected to said pins for selectively extending one or more of said pins toward said paper;

control means for receiving an input signal and selectively providing an activation signal to at least one of said drivers; and platen means comprising a fist platen rotatable about an axis and translatable across the paper with respect to the said line of motion for pressing said paper and said pins in close contact, whereby said selectively extended pin or pins may leave a tactile impression on said paper.

7. An apparatus as claimed in claim 6, wherein said paper receiving means further comprises bracket means for holding said platen means in contact with said paper.

8. An apparatus as claimed in claim 7, wherein said platen means comprises a reversible motor interconnected to said first platen for rolling said first platen over said pins.

9. An apparatus as claimed in claim 8, wherein said paper receiving means includes a cylindrical platen and a paper advance motor interconnected thereto for rotating said cylindrical platen.

10. An apparatus as claimed in claim 9, wherein said control means senses when said first platen substantially reaches one end of said cylindrical platen and responsively issues a roller signal to said reversible motor to stop movement of said first platen toward said one end of said cylindrical platen.

11. An apparatus as claimed in claim 10, wherein said control means issues a paper advance signal and said paper advance motor receives signal and responsively rotates said cylindrical platen.

12. An apparatus as claimed in claim 11, wherein a flexible belt interconnects said reversible motor and first platen.

13. An apparatus as claimed in claim 12, wherein said paper advance motor is a stepper motor.

14. An apparatus as claimed in claims 6 or 13, wherein said drive means comprises an electrical solenoid.

15. An apparatus as claimed in claim 14, wherein said drive means includes a spring for keeping said pin in a normally retracted position.

16. An apparatus as claimed in claim 15, wherein said solenoid may be activated to extend said pin and said drive means further comprises lock means for substantially preventing retraction of said pin upon activation of said solenoid.

17. An apparatus as claimed in claim 16, wherein said solenoid comprises a movable shaft and said lock means includes a block between said shaft and pin, said block defining an inclined surface and a top surface, whereby, upon activation of said solenoid, said shaft of said solenoid may urge said inclined surface against said pin.

18. An apparatus as in claim 1 wherein the housing includes a paper slot and the axis of the first platen remains at a substantially constant distance from the paper slot in operation.

19. An apparatus as in claim 6 wherein the housing includes a paper slot and the axis of the first platen remains at a substantially constant distance from the paper slot in operation.

* * * * *